US008875788B2

(12) United States Patent
Nguyen et al.

(10) Patent No.: US 8,875,788 B2
(45) Date of Patent: Nov. 4, 2014

(54) LOW TEMPERATURE INDUCTIVE HEATING OF SUBSURFACE FORMATIONS

(75) Inventors: Scott Vinh Nguyen, Houston, TX (US); Thomas David Fowler, Houston, TX (US)

(73) Assignee: Shell Oil Company, Houston, TX (US)

( * ) Notice: Subject to any disclaimer, the term of this patent is extended or adjusted under 35 U.S.C. 154(b) by 484 days.

(21) Appl. No.: 13/083,240

(22) Filed: Apr. 8, 2011

(65) Prior Publication Data

US 2011/0247819 A1 Oct. 13, 2011

Related U.S. Application Data

(60) Provisional application No. 61/322,635, filed on Apr. 9, 2010, provisional application No. 61/322,513, filed on Apr. 9, 2010.

(51) Int. Cl.
*E21B 36/00* (2006.01)
*E21B 43/24* (2006.01)

(52) U.S. Cl.
CPC ..... *E21B 43/24* (2013.01); *E21B 43/2408* (2013.01)
USPC ..... 166/302; 166/60

(58) Field of Classification Search
CPC ..... E21B 43/2401; E21B 43/24; E21B 36/04
USPC ..... 166/302, 272.1, 60
See application file for complete search history.

(56) References Cited

U.S. PATENT DOCUMENTS

| | | | |
|---|---|---|---|
| 48,994 | A | 7/1865 | Parry |
| 94,813 | A | 9/1885 | Dickey |
| 326,439 | A | 9/1885 | McEachen |
| 760,304 | A | 5/1904 | Butler |
| 1,342,741 | A | 6/1920 | Day |
| 1,510,655 | A | 6/1924 | Clark |

(Continued)

FOREIGN PATENT DOCUMENTS

| | | |
|---|---|---|
| CA | 1168283 | 5/1984 |
| CA | 1196594 | 11/1985 |

(Continued)

OTHER PUBLICATIONS

Some Effects of Pressure on Oil-Shale Retorting, Society of Petroleum Engineers Journal, J.H. Bae, Sep. 1969; pp. 287-292.

(Continued)

*Primary Examiner* — Kenneth L Thompson
*Assistant Examiner* — Michael Wills, III

(57) ABSTRACT

Electrical current flow is induced in a ferromagnetic conductor providing time-varying electrical current at a first frequency to an electrical conductor located in a formation. The ferromagnetic conductor at least partially surrounds and at least partially extends lengthwise around the electrical conductor. The ferromagnetic conductor resistively heats up to a first temperature of at most about 300° C. Water in the formation is vaporized with heat at the first temperature. Subsequently, time-varying electrical current at a second frequency is provided to the elongated electrical conductor to induce electrical current flow at the second frequency such that the ferromagnetic conductor resistively heats up to a second temperature above about 300° C. Heat transfers from the ferromagnetic conductor at the second temperature to at least a part of the formation to mobilize at least some hydrocarbons in the part of the formation.

12 Claims, 8 Drawing Sheets

(56) References Cited

U.S. PATENT DOCUMENTS

| | | | | |
|---|---|---|---|---|
| 1,634,236 | A | 6/1927 | Ranney | |
| 1,666,488 | A | 4/1928 | Crawshaw | |
| 1,681,523 | A | 8/1928 | Downey et. al. | |
| 1,913,395 | A | 6/1933 | Karrick | |
| 2,208,087 | A | 7/1940 | Somers | |
| 2,244,256 | A | 6/1941 | Looman | |
| 2,423,674 | A | 7/1947 | Agren | |
| 2,444,755 | A | 7/1948 | Steffen | |
| 2,466,945 | A | 4/1949 | Greene | |
| 2,472,445 | A | 6/1949 | Sprong | |
| 2,484,063 | A | 10/1949 | Ackley | |
| 2,500,305 | A | 3/1950 | Ackley | |
| 2,497,868 | A | 2/1951 | Dalin | |
| 2,548,360 | A | 4/1951 | Germain | |
| 2,593,477 | A | 4/1952 | Newman et al. | |
| 2,595,979 | A | 5/1952 | Pevere et al. | |
| 2,630,306 | A | 3/1953 | Evans | |
| 2,630,307 | A | 3/1953 | Martin | |
| 2,634,961 | A | 4/1953 | Ljungstrom | |
| 2,642,943 | A | 6/1953 | Smith et al. | |
| 2,670,802 | A | 3/1954 | Ackley | |
| 2,685,930 | A | 8/1954 | Albaugh | |
| 2,695,163 | A | 11/1954 | Pearce et al. | |
| 2,703,621 | A | 3/1955 | Ford | |
| 2,714,930 | A | 8/1955 | Carpenter | |
| 2,732,195 | A | 1/1956 | Ljungstrom | |
| 2,734,579 | A | 2/1956 | Elkins | |
| 2,771,954 | A | 11/1956 | Jenks et al. | |
| 2,777,679 | A | 1/1957 | Ljungstrom | |
| 2,780,449 | A | 2/1957 | Fisher et al. | |
| 2,780,450 | A | 2/1957 | Ljungstrom | |
| 2,786,660 | A | 3/1957 | Alleman | |
| 2,789,805 | A | 4/1957 | Ljungstrom | |
| 2,793,696 | A | 5/1957 | Morse | |
| 2,804,149 | A | 8/1957 | Kile | |
| 2,841,375 | A | 7/1958 | Salomonsson | |
| 2,890,754 | A | 6/1959 | Hoffstrom et al. | |
| 2,890,755 | A | 6/1959 | Eurenius et al. | |
| 2,902,270 | A | 9/1959 | Salomonsson et al. | |
| 2,906,337 | A | 9/1959 | Henning | |
| 2,906,340 | A | 9/1959 | Herzog | |
| 2,914,309 | A | 11/1959 | Salomonsson | |
| 2,923,535 | A | 2/1960 | Ljungstrom | |
| 2,932,352 | A | 4/1960 | Stegemeier | |
| 2,939,689 | A | 6/1960 | Ljungstrom | |
| 2,954,826 | A | 10/1960 | Sievers | |
| 3,220,479 | A | 11/1965 | Orloff et al. | |
| 3,515,213 | A | 6/1970 | Prats | |
| 4,001,760 | A | 1/1977 | Howie et al. | |
| 4,022,280 | A | 5/1977 | Stoddard et al. | |
| 5,117,912 | A | 6/1992 | Young | |
| 5,453,599 | A | 9/1995 | Hall, Jr. | |
| 5,875,283 | A | 2/1999 | Yane et al. | |
| 6,963,053 | B2 | 11/2005 | Lutz | |
| 7,013,972 | B2 | 3/2006 | Vinegar et al. | |
| 7,036,583 | B2 * | 5/2006 | de Rouffignac et al. | 166/245 |
| 7,051,811 | B2 | 5/2006 | de Rouffignac et al. | |
| 7,527,094 | B2 | 5/2009 | McKinzie et al. | |
| 7,743,826 | B2 | 6/2010 | Harris | |
| 8,113,272 | B2 | 2/2012 | Vinegar | |
| 8,146,661 | B2 | 4/2012 | Bravo et al. | |
| 8,146,669 | B2 | 4/2012 | Mason | |
| 8,151,880 | B2 | 4/2012 | Roes et al. | |
| 8,151,907 | B2 | 4/2012 | MacDonald | |
| 8,162,043 | B2 | 4/2012 | Burnham et al. | |
| 8,162,059 | B2 | 4/2012 | Nguyen et al. | |
| 8,162,405 | B2 | 4/2012 | Burns et al. | |
| 8,172,335 | B2 | 5/2012 | Burns et al. | |
| 8,177,305 | B2 | 5/2012 | Burns et al. | |
| 8,191,630 | B2 | 6/2012 | Stegemeier et al. | |
| 8,192,682 | B2 | 6/2012 | Maziasz et al. | |
| 8,196,658 | B2 | 6/2012 | Miller et al. | |
| 8,200,072 | B2 | 6/2012 | Vinegar et al. | |
| 8,220,539 | B2 | 7/2012 | Vinegar et al. | |
| 8,224,164 | B2 | 7/2012 | Sandberg et al. | |
| 8,224,165 | B2 | 7/2012 | Vinegar et al. | |
| 8,225,866 | B2 | 7/2012 | de Rouffignac | |
| 8,230,927 | B2 | 7/2012 | Fairbanks et al. | |
| 8,233,782 | B2 | 7/2012 | Vinegar et al. | |
| 8,238,730 | B2 | 8/2012 | Sandberg et al. | |
| 8,240,774 | B2 | 8/2012 | Vinegar et al. | |
| 8,256,512 | B2 | 9/2012 | Stanecki | |
| 8,257,112 | B2 | 9/2012 | Tilley | |
| 8,261,832 | B2 | 9/2012 | Ryan | |
| 8,267,185 | B2 | 9/2012 | Ocampos et al. | |
| 8,276,661 | B2 | 10/2012 | Costello et al. | |
| 8,281,861 | B2 | 10/2012 | Nguyen et al. | |
| 8,327,932 | B2 | 12/2012 | Karanikas | |
| 8,353,347 | B2 | 1/2013 | Mason | |
| 8,355,623 | B2 | 1/2013 | Vinegar et al. | |
| 8,381,815 | B2 | 2/2013 | Karanikas et al. | |
| 8,434,555 | B2 | 5/2013 | Bos et al. | |
| 8,450,540 | B2 | 5/2013 | Roes et al. | |
| 8,459,359 | B2 | 6/2013 | Vinegar | |
| 8,485,252 | B2 | 7/2013 | de Rouffignac et al. | |
| 8,485,256 | B2 | 7/2013 | Bass et al. | |
| 8,502,120 | B2 | 8/2013 | Bass et al. | |
| 8,536,497 | B2 | 9/2013 | Kim | |
| 8,555,971 | B2 | 10/2013 | Vinegar et al. | |
| 8,562,078 | B2 | 10/2013 | Burns et al. | |
| 8,606,091 | B2 | 12/2013 | John et al. | |
| 8,627,887 | B2 | 1/2014 | Vinegar et al. | |
| 8,631,866 | B2 | 1/2014 | Nguyen | |
| 8,636,323 | B2 | 1/2014 | Prince-Wright et al. | |
| 8,662,175 | B2 | 3/2014 | Karanikas et al. | |
| 2002/0027001 | A1 | 3/2002 | Wellington et al. | |
| 2005/0269095 | A1 * | 12/2005 | Fairbanks | 166/302 |
| 2009/0126929 | A1 * | 5/2009 | Vinegar | 166/263 |
| 2009/0260811 | A1 | 10/2009 | Cui et al. | |
| 2010/0258309 | A1 * | 10/2010 | Ayodele et al. | 166/272.3 |
| 2011/0259590 | A1 | 10/2011 | Burnham et al. | |
| 2012/0018421 | A1 | 1/2012 | Parman et al. | |
| 2012/0085535 | A1 | 4/2012 | Mo et al. | |
| 2012/0193099 | A1 | 8/2012 | Vinegar et al. | |
| 2012/0205109 | A1 | 8/2012 | Burnham et al. | |

FOREIGN PATENT DOCUMENTS

| | | |
|---|---|---|
| CA | 1253555 | 5/1989 |
| CA | 1288043 | 8/1991 |
| CA | 2015460 | 10/1991 |
| EP | 0940558 | 9/1999 |
| GB | 156396 | 1/1921 |
| GB | 674082 | 7/1950 |
| GB | 1454324 | 11/1976 |
| SE | 121737 | 5/1948 |
| SE | 123136 | 11/1948 |
| SE | 123137 | 11/1948 |
| SE | 123138 | 11/1948 |
| SE | 126674 | 11/1949 |
| SU | 1836876 | 12/1990 |
| WO | 9506093 | 3/1995 |
| WO | 9901640 | 1/1999 |
| WO | 0181505 | 11/2001 |

OTHER PUBLICATIONS

New in situ shale-oil recovery process uses hot natural gas; The Oil & Gas Journal; May 16, 1966, p. 151.

Evaluation of Downhole Electric Impedance Heating Systems for Paraffin Control in Oil Wells; Industry Applications Society 37th Annual Petroleum and Chemical Industry Conference; The Institute of Electrical and Electronics Engineers Inc., Bosch et al., Sep. 1990, pp. 223-227.

New System Stops Paraffin Build-up; Petroleum Engineer, Eastlund et al., Jan. 1989, (3 pages).

Oil Shale Retorting: Effects of Particle Size and Heating Rate on Oil Evolution and Intraparticle Oil Degradation; Campbell et al. In Situ 2(1), 1978, pp. 1-47.

The Potential for In Situ Retorting of Oil Shale in the Piceance Creek Basin of Northwestern Colorado; Dougan et al., Quarterly of the Colorado School of Mines, pp. 57-72, , 1970.

(56) References Cited

OTHER PUBLICATIONS

Retoring Oil Shale Underground-Problems & Possibilities; B.F. Grant, Qtly of Colorado School of Mines, pp. 39-46, 1960.
Molecular Mechanism of Oil Shale Pyrolysis in Nitrogen and Hydrogen Atmospheres, Hershkowitz et al.; Geochemistry and Chemistry of Oil Shales, American Chemical Society, May, 1983 pp. 301-316.
The Characteristics of a Low Temperature in Situ Shale Oil; George Richard Hill & Paul Dougan, Quarterly of the Colorado School of Mines, 1967; pp. 75-90.
Direct Production of a Low Pour Point High Gravity Shale Oil; Hill et al., I & EC Product Research and Development, 6(1), Mar. 1967; pp. 52-59.
Refining of Swedish Shale Oil, L. Lundquist, pp. 621-627, 1951.
The Benefits of In Situ Upgrading Reactions to the Integrated Operations of the Orinoco Heavy-Oil Fields and Downstream Facilities, Myron Kuhlman, Society of Petroleum Engineers, Jun. 2000; pp. 1-14.
Monitoring Oil Shale Retorts by Off-Gas Alkene/Alkane Ratios, John H. Raley, Fuel, vol. 59, Jun. 1980, pp. 419-424.
The Shale Oil Question, Old and New Viewpoints, A Lecture in the Engineering Science Academy, Dr. Fredrik Ljungstrom, Feb. 23, 1950, published in Teknisk Trdskrift, Jan. 1951 p. 33-40.
Underground Shale Oil Pyrolysis According to the Ljungstroem Method; Svenska Skifferolje Aktiebolaget (Swedish Shale Oil Corp. ), IVA, vol. 24, 1953, No. 3, pp. 118-123.
Kinetics of Low-Temperature Pyrolysis of Oil Shale by the IITRI RF Process, Sresty et al.; 15th Oil Shale Symposium, Colorado School of Mines, Apr. 1982 pp. 1-13.
Bureau of Mines Oil-Shale Research, H.M. Thorne, Quarterly of the Colorado School of Mines, pp. 77-90, 1964.
Application of a Microretort to Problems in Shale Pyrolysis, A. W. Weitkamp & L.C. Gutberlet, Ind. Eng. Chem. Process Des. Develop. vol. 9, No. 3, 1970, pp. 386-395.
Oil Shale, Yen et al., Developments in Petroleum Science 5, 1976, pp. 187-189, 197-198.
The Composition of Green River Shale Oils, Glenn L. Cook, et al., United Nations Symposium on the Development and Utilization of Oil Shale Resources, 1968, pp. 1-23.
High-Pressure Pyrolysis of Green River Oil Shale, Burnham et al., Geochemistry and Chemistry of Oil Shales, American Chemical Society, 1983, pp. 335-351.
Geochemistry and Pyrolysis of Oil Shales, Tissot et al., Geochemistry and Chemistry of Oil Shales, American Chemical Society, 1983, pp. 1-11.
A Possible Mechanism of Alkene/Alkane Production, Burnham et al., Oil Shale, Tar Sands, and Related Materials, American Chemical Society, 1981, pp. 79-92.
The Ljungstroem In-Situ Method of Shale Oil Recovery, G. Salomonsson, Oil Shale and Cannel Coal, vol. 2, Proceedings of the Second Oil Shale and Cannel Coal Conference, Institute of Petroleum, 1951, London, pp. 260-280.
Developments in Technology for Green River Oil Shale, G.U. Dinneen, United Nations Symposium on the Development and Utilization of Oil Shale Resources, Laramie Petroleum Research Center, Bureau of Mines, 1968, pp. 1-20.
The Thermal and Structural Properties of a Hanna Basin Coal, R.E. Glass, Transactions of the ASME, vol. 106, Jun. 1984, pp. 266-271.
On the Mechanism of Kerogen Pyrolysis, Alan K. Burnham & James A. Happe, Jan. 10, 1984 (17 pages).
Comparison of Methods for Measuring Kerogen Pyrolysis Rates and Fitting Kinetic Parameters, Burnham et al., Mar. 23, 1987, (29 pages).
Further Comparison of Methods for Measuring Kerogen Pyrolysis Rates and Fitting Kinetic Parameters, Bumham et al., Sep. 1987, (16 pages).
Shale Oil Cracking Kinetics and Diagnostics, Bissell et al., Nov. 1983, (27 pages).
Mathematical Modeling of Modified In Situ and Aboveground Oil Shale Retorting, Robert L. Braun, Jan. 1981 (45 pages).
Progress Report on Computer Model for In Situ Oil Shale Retorting, R.L. Braun & R.C.Y. Chin, Jul. 14, 1977 (34 pages).
Chemical Kinetics and Oil Shale Process Design, Alan K. Burnham, Jul. 1993 (16 pages).
Reaction Kinetics and Diagnostics for Oil Shale Retorting, Alan K. Burnham, Oct. 19, 1981 (32 pages).
Reaction Kinetics Between Steam and Oil Shale Char, A.K. Burnham, Oct. 1978 (8 pages).
General Kinetic Model of Oil Shale Pyrolysis, Alan K. Burnham & Robert L. Braun, Dec. 1984 (25 pages).
U.S. Patent and Trademark Office, Office Communication for U.S. Appl. No. 12/106,065; mailed Jun. 27, 2012.
U.S. Patent and Trademark Office, Office Communication for U.S. Appl. No. 12/757,650; mailed Jul. 19, 2012.
U.S. Patent and Trademark Office, Office Communication for U.S. Appl. No. 12/757,661; mailed Aug. 27, 2012.
U.S. Patent and Trademark Office, Office Communication for U.S. Appl. No. 12/250,346; mailed Sep. 5, 2012.
U.S. Patent and Trademark Office, "Office Communication," for U.S. Appl. No. 11/113,353 mailed Sep. 20, 2012.
U.S. Patent and Trademark Office, Office Communication for U.S. Appl. No. 12/576,772; mailed Dec. 12, 2012.
U.S. Patent and Trademark Office, Office Communication for U.S. Appl. No. 12/757,661; mailed Mar. 7, 2013.
PCT "Search Report and Written Opinion" for International Application No. PCT/US2011/031549 mailed, Jun. 10, 2011; 4 pages.
U.S. Patent and Trademark Office, Office Communication for U.S. Appl. No. 12/576,815; mailed May 8, 2012.
U.S. Patent and Trademark Office, Office Communication for U.S. Appl. No. 12/576,825; mailed Jun. 19, 2012.
U.S. Patent and Trademark Office, Office Communication for U.S. Appl. No. 12/576,825; mailed Dec. 27, 2013.
Japanese Communication for Japanese Patent Application No. 2011-531195, mailed Aug. 13, 2013, 3 pages.
U.S. Patent and Trademark Office, Office Communication for U.S. Appl. No. 13/083,215; mailed May 8, 2013.
U.S. Patent and Trademark Office, Office Communication for U.S. Appl. No. 13/083,225; mailed May 8, 2013.
U.S. Patent and Trademark Office, Office Communication for U.S. Appl. No. 12/422,110; mailed Aug. 14, 2013.
U.S. Patent and Trademark Office, Office Communication for U.S. Appl. No. 13/411,300; mailed Oct. 16, 2013.
U.S. Patent and Trademark Office, Office Communication for U.S. Appl. No. 13/738,345; mailed Oct. 16, 2013.
U.S. Patent and Trademark Office, Office Communication for U.S. Appl. No. 13/567,799; mailed Oct. 16, 2013.
U.S. Patent and Trademark Office, Office Communication for U.S. Appl. No. 13/083,177; mailed Oct. 9, 2013.
U.S. Patent and Trademark Office, Office Communication for U.S. Appl. No. 13/960,355; mailed Dec. 3, 2013.

* cited by examiner

LOW TEMPERATURE INDUCTIVE HEATING OF SUBSURFACE FORMATIONS

PRIORITY CLAIM

This patent application claims priority to U.S. Provisional Patent No. 61/322,635 entitled "ELECTRODES FOR ELECTRICAL CURRENT FLOW AND INDUCTIVE HEATING OF SUBSURFACE FORMATIONS" to Harris et al. filed on Apr. 9, 2010; U.S. Provisional Patent No. 61/322,513 entitled "TREATMENT METHODOLOGIES FOR SUBSURFACE HYDROCARBON CONTAINING FORMATIONS" to Bass et al. filed on Apr. 9, 2010; and International Patent Application No. PCT/US11/31549 entitled "LOW TEMPERATURE INDUCTIVE HEATING OF SUBSURFACE FORMATIONS" to Nguyen et al. filed on Apr. 7, 2011, all of which are incorporated by reference in their entirety.

RELATED PATENTS

This patent application incorporates by reference in its entirety each of U.S. Pat. Nos. 6,688,387 to Wellington et al.; 6,991,036 to Sumnu-Dindoruk et al.; 6,698,515 to Karanikas et al.; 6,880,633 to Wellington et al.; 6,782,947 to de Rouffignac et al.; 6,991,045 to Vinegar et al.; 7,073,578 to Vinegar et al.; 7,121,342 to Vinegar et al.; 7,320,364 to Fairbanks; 7,527,094 to McKinzie et al.; 7,584,789 to Mo et al.; 7,533,719 to Hinson et al.; 7,562,707 to Miller; 7,841,408 to Vinegar et al.; and 7,866,388 to Bravo; U.S. Patent Application Publication Nos. 2010-0071903 to Prince-Wright et al. and 2010-0096137 to Nguyen et al.

BACKGROUND

1. Field of the Invention

The present invention relates generally to systems, methods and heat sources for production of hydrocarbons, hydrogen, and/or other products. The present invention relates in particular to systems and methods using heat sources for treating various subsurface hydrocarbon formations.

2. Description of Related Art

Hydrocarbons obtained from subterranean formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources. In situ processes may be used to remove hydrocarbon materials from subterranean formations. Chemical and/or physical properties of hydrocarbon material in a subterranean formation may need to be changed to allow hydrocarbon material to be more easily removed from the subterranean formation. The chemical and physical changes may include in situ reactions that produce removable fluids, composition changes, solubility changes, density changes, phase changes, and/or viscosity changes of the hydrocarbon material in the formation. A fluid may be, but is not limited to, a gas, a liquid, an emulsion, a slurry, and/or a stream of solid particles that has flow characteristics similar to liquid flow.

Subsurface formations (for example, tar sands or heavy hydrocarbon formations) include dielectric media. Dielectric media may exhibit conductivity, relative dielectric constant, and loss tangents. Loss of conductivity may occur as the formation is heated to temperatures above the boiling point of water in the formation (for example, above 100° C.) due to the loss of moisture contained in the interstitial spaces in the rock matrix of the formation. To prevent loss of moisture, formations may be heated at temperatures and pressures that minimize vaporization of water. Conductive solutions may be added to the formation to help maintain the electrical properties of the formation.

Formations may be heated using electrodes to temperatures and pressures that vaporize the water and/or conductive solutions. Material used to produce the current flow, however, may become damaged due to heat stress and/or loss of conductive solutions may limit heat transfer in the layer. In addition, when using electrodes, magnetic fields may form. Due to the presence of magnetic fields, non-ferromagnetic materials may be desired for overburden casings.

U.S. Pat. No. 4,084,637 to Todd, which is incorporated by reference as if fully set forth herein, describes methods of producing viscous materials from subterranean formations that includes passing electrical current through the subterranean formation. As the electrical current passes through the subterranean formation, the viscous material is heated to thereby lower the viscosity of such material. Following the heating of the subterranean formation in the vicinity of the path formed by the electrode wells, a driving fluid is injected through the injection wells to thereby migrate along the path and force the material having a reduced viscosity toward the production well. The material is produced through the production well and by continuing to inject a heated fluid through the injection wells, substantially all of the viscous material in the subterranean formation can be heated to lower its viscosity and be produced from the production well.

U.S. Pat. No. 4,926,941 to Glandt et al., which is incorporated by reference as if fully set forth herein, describes producing thick tar sand deposits by preheating of thin, relatively conductive layers which are a small fraction of the total thickness of a tar sand deposit. The thin conductive layers serve to confine the heating within the tar sands to a thin zone adjacent to the conductive layers even for large distances between rows of electrodes. The preheating is continued until the viscosity of the tar in a thin preheated zone adjacent to the conductive layers is reduced sufficiently to allow steam injection into the tar sand deposit. The entire deposit is then produced by steam flooding.

U.S. Pat. No. 5,046,559 to Glandt, which is incorporated by reference as if fully set forth herein, describes an apparatus and method for producing thick tar sand deposits by electrically preheating paths of increased injectivity between an injector and producers. The injector and producers are arranged in a triangular pattern with the injector located at the apex and the producers located on the base of the triangle. These paths of increased injectivity are then steam flooded to produce the hydrocarbons.

As discussed above, there has been a significant amount of effort to develop methods and systems to economically produce hydrocarbons, hydrogen, and/or other products from hydrocarbon containing formations. At present, however, there are still many hydrocarbon containing formations from which hydrocarbons, hydrogen, and/or other products cannot be economically produced. Thus, there is a need for improved methods and systems for heating of a hydrocarbon formation and production of fluids from the hydrocarbon formation. There is also a need for improved methods and systems that reduce energy costs for treating the formation, reduce emissions from the treatment process, facilitate heating system installation, and/or reduce heat loss to the overburden as compared to hydrocarbon recovery processes that utilize surface based equipment.

SUMMARY

Embodiments described herein generally relate to systems, methods, and heaters for treating a subsurface formation.

Embodiments described herein also generally relate to heaters that have novel components therein. Such heaters can be obtained by using the systems and methods described herein.

In certain embodiments, the invention provides one or more systems, methods, and/or heaters. In some embodiments, the systems, methods, and/or heaters are used for treating a subsurface formation.

In certain embodiments, a method for heating a hydrocarbon containing formation includes: providing time-varying electrical current at a first frequency to an elongated electrical conductor located in the formation; inducing electrical current flow in a ferromagnetic conductor with the time-varying electrical current at the first frequency, wherein the ferromagnetic conductor at least partially surrounds and at least partially extends lengthwise around the electrical conductor; resistively heating the ferromagnetic conductor with the induced electrical current flow such that the ferromagnetic conductor resistively heats up to a first temperature, wherein the first temperature is at most about 300° C.; allowing heat to transfer from the ferromagnetic conductor at the first temperature to at least a part of the formation; vaporizing at least some water in the formation with the ferromagnetic conductor at the first temperature; providing time-varying electrical current at a second frequency to the elongated electrical conductor; inducing electrical current flow in the ferromagnetic conductor with the time-varying electrical current at the second frequency; resistively heating the ferromagnetic conductor with the induced electrical current flow such that the ferromagnetic conductor resistively heats up to a second temperature, wherein the second temperature is above about 300° C.; allowing heat to transfer from the ferromagnetic conductor at the second temperature to at least a part of the formation; and mobilizing at least some hydrocarbons in the part of the formation with the ferromagnetic conductor at the second temperature.

In further embodiments, features from specific embodiments may be combined with features from other embodiments. For example, features from one embodiment may be combined with features from any of the other embodiments.

In further embodiments, treating a subsurface formation is performed using any of the methods, systems, power supplies, or heaters described herein.

In further embodiments, additional features may be added to the specific embodiments described herein.

BRIEF DESCRIPTION OF THE DRAWINGS

Features and advantages of the methods and apparatus of the present invention will be more fully appreciated by reference to the following detailed description of presently preferred but nonetheless illustrative embodiments in accordance with the present invention when taken in conjunction with the accompanying drawings.

Figure 1:
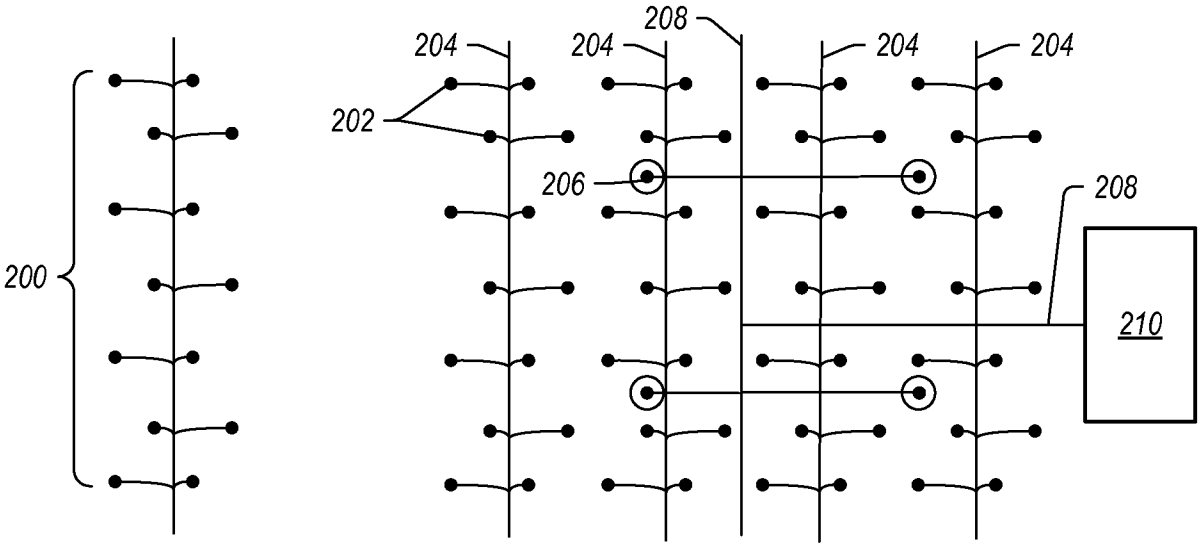
FIG. 1 shows a schematic view of an embodiment of a portion of an in situ heat treatment system for treating a hydrocarbon containing formation.

While the invention is susceptible to various modifications and alternative forms, specific embodiments thereof are shown by way of example in the drawings and will herein be described in detail. The drawings may not be to scale. It should be understood that the drawings and detailed description thereto are not intended to limit the invention to the particular form disclosed, but to the contrary, the intention is to cover all modifications, equivalents and alternatives falling within the spirit and scope of the present invention as defined by the appended claims.

DETAILED DESCRIPTION

The following description generally relates to systems and methods for treating hydrocarbons in the formations. Such formations may be treated to yield hydrocarbon products, hydrogen, and other products.

"Alternating current (AC)" refers to a time-varying current that reverses direction substantially sinusoidally. AC produces skin effect electricity flow in a ferromagnetic conductor.

In the context of reduced heat output heating systems, apparatus, and methods, the term "automatically" means such systems, apparatus, and methods function in a certain way without the use of external control (for example, external controllers such as a controller with a temperature sensor and a feedback loop, PID controller, or predictive controller).

"Coupled" means either a direct connection or an indirect connection (for example, one or more intervening connections) between one or more objects or components. The phrase "directly connected" means a direct connection between objects or components such that the objects or components are connected directly to each other so that the objects or components operate in a "point of use" manner.

"Curie temperature" is the temperature above which a ferromagnetic material loses all of its ferromagnetic properties. In addition to losing all of its ferromagnetic properties above the Curie temperature, the ferromagnetic material begins to lose its ferromagnetic properties when an increasing electrical current is passed through the ferromagnetic material.

A "formation" includes one or more hydrocarbon containing layers, one or more non-hydrocarbon layers, an overburden, and/or an underburden. "Hydrocarbon layers" refer to layers in the formation that contain hydrocarbons. The hydrocarbon layers may contain non-hydrocarbon material and hydrocarbon material. The "overburden" and/or the "underburden" include one or more different types of impermeable materials. For example, the overburden and/or underburden may include rock, shale, mudstone, or wet/tight carbonate. In some embodiments of in situ heat treatment processes, the overburden and/or the underburden may include a hydrocarbon containing layer or hydrocarbon containing layers that are relatively impermeable and are not subjected to temperatures during in situ heat treatment processing that result in significant characteristic changes of the hydrocarbon containing layers of the overburden and/or the underburden. For example, the underburden may contain shale or mudstone, but the underburden is not allowed to heat to pyrolysis temperatures during the in situ heat treatment process. In some cases, the overburden and/or the underburden may be somewhat permeable.

"Formation fluids" refer to fluids present in a formation and may include pyrolyzation fluid, synthesis gas, mobilized hydrocarbons, and water (steam). Formation fluids may include hydrocarbon fluids as well as non-hydrocarbon fluids. The term "mobilized fluid" refers to fluids in a hydrocarbon containing formation that are able to flow as a result of thermal treatment of the formation. "Produced fluids" refer to fluids removed from the formation.

"Heat flux" is a flow of energy per unit of area per unit of time (for example, Watts/meter$^2$).

A "heat source" is any system for providing heat to at least a portion of a formation substantially by conductive and/or radiative heat transfer. For example, a heat source may include electrically conducting materials and/or electric heaters such as an insulated conductor, an elongated member, and/or a conductor disposed in a conduit. A heat source may also include systems that generate heat by burning a fuel external to or in a formation. The systems may be surface burners, downhole gas burners, flameless distributed combustors, and natural distributed combustors. In some embodiments, heat provided to or generated in one or more heat sources may be supplied by other sources of energy. The other sources of energy may directly heat a formation, or the energy may be applied to a transfer medium that directly or indirectly heats the formation. It is to be understood that one or more heat sources that are applying heat to a formation may use different sources of energy. Thus, for example, for a given formation some heat sources may supply heat from electrically conducting materials, electric resistance heaters, some heat sources may provide heat from combustion, and some heat sources may provide heat from one or more other energy sources (for example, chemical reactions, solar energy, wind energy, biomass, or other sources of renewable energy). A chemical reaction may include an exothermic reaction (for example, an oxidation reaction). A heat source may also include an electrically conducting material and/or a heater that provides heat to a zone proximate and/or surrounding a heating location such as a heater well.

A "heater" is any system or heat source for generating heat in a well or a near wellbore region. Heaters may be, but are not limited to, electric heaters, burners, combustors that react with material in or produced from a formation, and/or combinations thereof.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. "Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and ammonia.

An "in situ conversion process" refers to a process of heating a hydrocarbon containing formation from heat sources to raise the temperature of at least a portion of the formation above a pyrolysis temperature so that pyrolyzation fluid is produced in the formation.

An "in situ heat treatment process" refers to a process of heating a hydrocarbon containing formation with heat sources to raise the temperature of at least a portion of the formation above a temperature that results in mobilized fluid, visbreaking, and/or pyrolysis of hydrocarbon containing material so that mobilized fluids, visbroken fluids, and/or pyrolyzation fluids are produced in the formation.

"Insulated conductor" refers to any elongated material that is able to conduct electricity and that is covered, in whole or in part, by an electrically insulating material.

"Modulated direct current (DC)" refers to any substantially non-sinusoidal time-varying current that produces skin effect electricity flow in a ferromagnetic conductor.

"Nitride" refers to a compound of nitrogen and one or more other elements of the Periodic Table. Nitrides include, but are not limited to, silicon nitride, boron nitride, or alumina nitride.

"Perforations" include openings, slits, apertures, or holes in a wall of a conduit, tubular, pipe or other flow pathway that allow flow into or out of the conduit, tubular, pipe or other flow pathway.

"Phase transformation temperature" of a ferromagnetic material refers to a temperature or a temperature range during which the material undergoes a phase change (for example, from ferrite to austenite) that decreases the magnetic permeability of the ferromagnetic material. The reduction in magnetic permeability is similar to reduction in magnetic permeability due to the magnetic transition of the ferromagnetic material at the Curie temperature.

"Pyrolysis" is the breaking of chemical bonds due to the application of heat. For example, pyrolysis may include transforming a compound into one or more other substances by heat alone. Heat may be transferred to a section of the formation to cause pyrolysis.

"Pyrolyzation fluids" or "pyrolysis products" refers to fluid produced substantially during pyrolysis of hydrocarbons. Fluid produced by pyrolysis reactions may mix with other fluids in a formation. The mixture would be considered pyrolyzation fluid or pyrolyzation product. As used herein, "pyrolysis zone" refers to a volume of a formation (for example, a relatively permeable formation such as a tar sands formation) that is reacted or reacting to form a pyrolyzation fluid.

"Superposition of heat" refers to providing heat from two or more heat sources to a selected section of a formation such that the temperature of the formation at least at one location between the heat sources is influenced by the heat sources.

A "tar sands formation" is a formation in which hydrocarbons are predominantly present in the form of heavy hydrocarbons and/or tar entrained in a mineral grain framework or other host lithology (for example, sand or carbonate). Examples of tar sands formations include formations such as the Athabasca formation, the Grosmont formation, and the Peace River formation, all three in Alberta, Canada; and the Faja formation in the Orinoco belt in Venezuela.

"Temperature limited heater" generally refers to a heater that regulates heat output (for example, reduces heat output) above a specified temperature without the use of external controls such as temperature controllers, power regulators, rectifiers, or other devices. Temperature limited heaters may be AC (alternating current) or modulated (for example, "chopped") DC (direct current) powered electrical resistance heaters.

"Thermally conductive fluid" includes fluid that has a higher thermal conductivity than air at standard temperature and pressure (STP) (0° C. and 101.325 kPa).

"Thermal conductivity" is a property of a material that describes the rate at which heat flows, in steady state, between two surfaces of the material for a given temperature difference between the two surfaces.

"Thickness" of a layer refers to the thickness of a cross section of the layer, wherein the cross section is normal to a face of the layer.

"Time-varying current" refers to electrical current that produces skin effect electricity flow in a ferromagnetic conductor and has a magnitude that varies with time. Time-varying current includes both alternating current (AC) and modulated direct current (DC).

"Turndown ratio" for the temperature limited heater in which current is applied directly to the heater is the ratio of the highest AC or modulated DC resistance below the Curie temperature to the lowest resistance above the Curie temperature for a given current. Turndown ratio for an inductive heater is the ratio of the highest heat output below the Curie temperature to the lowest heat output above the Curie temperature for a given current applied to the heater.

A "u-shaped wellbore" refers to a wellbore that extends from a first opening in the formation, through at least a portion of the formation, and out through a second opening in the formation. In this context, the wellbore may be only roughly in the shape of a "v" or "u", with the understanding that the "legs" of the "u" do not need to be parallel to each other, or perpendicular to the "bottom" of the "u" for the wellbore to be considered "u-shaped".

The term "wellbore" refers to a hole in a formation made by drilling or insertion of a conduit into the formation. A wellbore may have a substantially circular cross section, or another cross-sectional shape. As used herein, the terms "well" and "opening," when referring to an opening in the formation may be used interchangeably with the term "wellbore."

A formation may be treated in various ways to produce many different products. Different stages or processes may be used to treat the formation during an in situ heat treatment process. In some embodiments, one or more sections of the formation are solution mined to remove soluble minerals from the sections. Solution mining minerals may be performed before, during, and/or after the in situ heat treatment process. In some embodiments, the average temperature of one or more sections being solution mined may be maintained below about 120° C.

In some embodiments, one or more sections of the formation are heated to remove water from the sections and/or to remove methane and other volatile hydrocarbons from the sections. In some embodiments, the average temperature may be raised from ambient temperature to temperatures below about 220° C. during removal of water and volatile hydrocarbons.

In some embodiments, one or more sections of the formation are heated to temperatures that allow for movement and/or visbreaking of hydrocarbons in the formation. In some embodiments, the average temperature of one or more sections of the formation are raised to mobilization temperatures of hydrocarbons in the sections (for example, to temperatures ranging from 100° C. to 250° C., from 120° C. to 240° C., or from 150° C. to 230° C.).

In some embodiments, one or more sections are heated to temperatures that allow for pyrolysis reactions in the formation. In some embodiments, the average temperature of one or more sections of the formation may be raised to pyrolysis temperatures of hydrocarbons in the sections (for example, temperatures ranging from 230° C. to 900° C., from 240° C. to 400° C. or from 250° C. to 350° C.).

Heating the hydrocarbon containing formation with a plurality of heat sources may establish thermal gradients around the heat sources that raise the temperature of hydrocarbons in the formation to desired temperatures at desired heating rates. The rate of temperature increase through mobilization temperature range and/or pyrolysis temperature range for desired products may affect the quality and quantity of the formation fluids produced from the hydrocarbon containing formation. Slowly raising the temperature of the formation through the mobilization temperature range and/or pyrolysis temperature range may allow for the production of high quality, high API gravity hydrocarbons from the formation. Slowly raising the temperature of the formation through the mobilization temperature range and/or pyrolysis temperature range may allow for the removal of a large amount of the hydrocarbons present in the formation as hydrocarbon product.

In some in situ heat treatment embodiments, a portion of the formation is heated to a desired temperature instead of slowly raising the temperature through a temperature range. In some embodiments, the desired temperature is 300° C., 325° C., or 350° C. Other temperatures may be selected as the desired temperature.

Superposition of heat from heat sources allows the desired temperature to be relatively quickly and efficiently established in the formation. Energy input into the formation from the heat sources may be adjusted to maintain the temperature in the formation substantially at a desired temperature.

Mobilization and/or pyrolysis products may be produced from the formation through production wells. In some embodiments, the average temperature of one or more sections is raised to mobilization temperatures and hydrocarbons are produced from the production wells. The average temperature of one or more of the sections may be raised to pyrolysis temperatures after production due to mobilization decreases below a selected value. In some embodiments, the average temperature of one or more sections may be raised to pyrolysis temperatures without significant production before reaching pyrolysis temperatures. Formation fluids including pyrolysis products may be produced through the production wells.

In some embodiments, the average temperature of one or more sections may be raised to temperatures sufficient to allow synthesis gas production after mobilization and/or pyrolysis. In some embodiments, hydrocarbons may be raised to temperatures sufficient to allow synthesis gas production without significant production before reaching the temperatures sufficient to allow synthesis gas production. For example, synthesis gas may be produced in a temperature range from about 400° C. to about 1200° C., about 500° C. to about 1100° C., or about 550° C. to about 1000° C. A synthesis gas generating fluid (for example, steam and/or water) may be introduced into the sections to generate synthesis gas. Synthesis gas may be produced from production wells.

Solution mining, removal of volatile hydrocarbons and water, mobilizing hydrocarbons, pyrolyzing hydrocarbons, generating synthesis gas, and/or other processes may be performed during the in situ heat treatment process. In some embodiments, some processes may be performed after the in situ heat treatment process. Such processes may include, but are not limited to, recovering heat from treated sections, storing fluids (for example, water and/or hydrocarbons) in previously treated sections, and/or sequestering carbon dioxide in previously treated sections.

FIG. 1 depicts a schematic view of an embodiment of a portion of the in situ heat treatment system for treating the hydrocarbon containing formation. The in situ heat treatment system may include barrier wells 200. Barrier wells are used to form a barrier around a treatment area. The barrier inhibits fluid flow into and/or out of the treatment area. Barrier wells include, but are not limited to, dewatering wells, vacuum wells, capture wells, injection wells, grout wells, freeze wells, or combinations thereof. In some embodiments, barrier wells 200 are dewatering wells. Dewatering wells may remove liquid water and/or inhibit liquid water from entering a portion of the formation to be heated, or to the formation being heated. In the embodiment depicted in FIG. 1, the barrier wells 200 are shown extending only along one side of heat sources 202, but the barrier wells typically encircle all heat sources 202 used, or to be used, to heat a treatment area of the formation.

Heat sources 202 are placed in at least a portion of the formation. Heat sources 202 may include heaters such as insulated conductors, conductor-in-conduit heaters, surface burners, flameless distributed combustors, and/or natural distributed combustors. Heat sources 202 may also include other types of heaters. Heat sources 202 provide heat to at least a portion of the formation to heat hydrocarbons in the formation. Energy may be supplied to heat sources 202 through supply lines 204. Supply lines 204 may be structurally different depending on the type of heat source or heat sources used to heat the formation. Supply lines 204 for heat sources may transmit electricity for electric heaters, may transport fuel for combustors, or may transport heat exchange fluid that is circulated in the formation. In some embodiments, electricity for an in situ heat treatment process may be provided by a nuclear power plant or nuclear power plants. The use of nuclear power may allow for reduction or elimination of carbon dioxide emissions from the in situ heat treatment process.

When the formation is heated, the heat input into the formation may cause expansion of the formation and geomechanical motion. The heat sources may be turned on before, at the same time, or during a dewatering process. Computer simulations may model formation response to heating. The computer simulations may be used to develop a pattern and time sequence for activating heat sources in the formation so that geomechanical motion of the formation does not adversely affect the functionality of heat sources, production wells, and other equipment in the formation.

Heating the formation may cause an increase in permeability and/or porosity of the formation. Increases in permeability and/or porosity may result from a reduction of mass in the formation due to vaporization and removal of water, removal of hydrocarbons, and/or creation of fractures. Fluid may flow more easily in the heated portion of the formation because of the increased permeability and/or porosity of the formation. Fluid in the heated portion of the formation may move a considerable distance through the formation because of the increased permeability and/or porosity. The considerable distance may be over 1000 m depending on various factors, such as permeability of the formation, properties of the fluid, temperature of the formation, and pressure gradient allowing movement of the fluid. The ability of fluid to travel considerable distance in the formation allows production wells 206 to be spaced relatively far apart in the formation.

Production wells 206 are used to remove formation fluid from the formation. In some embodiments, production well 206 includes a heat source. The heat source in the production well may heat one or more portions of the formation at or near the production well. In some in situ heat treatment process embodiments, the amount of heat supplied to the formation from the production well per meter of the production well is less than the amount of heat applied to the formation from a heat source that heats the formation per meter of the heat source. Heat applied to the formation from the production well may increase formation permeability adjacent to the production well by vaporizing and removing liquid phase fluid adjacent to the production well and/or by increasing the permeability of the formation adjacent to the production well by formation of macro and/or micro fractures.

More than one heat source may be positioned in the production well. A heat source in a lower portion of the production well may be turned off when superposition of heat from adjacent heat sources heats the formation sufficiently to counteract benefits provided by heating the formation with the production well. In some embodiments, the heat source in an upper portion of the production well may remain on after the heat source in the lower portion of the production well is deactivated. The heat source in the upper portion of the well may inhibit condensation and reflux of formation fluid.

In some embodiments, the heat source in production well 206 allows for vapor phase removal of formation fluids from the formation. Providing heating at or through the production well may: (1) inhibit condensation and/or refluxing of production fluid when such production fluid is moving in the production well proximate the overburden, (2) increase heat input into the formation, (3) increase production rate from the production well as compared to a production well without a heat source, (4) inhibit condensation of high carbon number compounds (C6 hydrocarbons and above) in the production well, and/or (5) increase formation permeability at or proximate the production well.

Subsurface pressure in the formation may correspond to the fluid pressure generated in the formation. As temperatures in the heated portion of the formation increase, the pressure in the heated portion may increase as a result of thermal expansion of in situ fluids, increased fluid generation and vaporization of water. Controlling rate of fluid removal from the formation may allow for control of pressure in the formation. Pressure in the formation may be determined at a number of different locations, such as near or at production wells, near or at heat sources, or at monitor wells.

In some hydrocarbon containing formations, production of hydrocarbons from the formation is inhibited until at least some hydrocarbons in the formation have been mobilized and/or pyrolyzed. Formation fluid may be produced from the formation when the formation fluid is of a selected quality. In some embodiments, the selected quality includes an API gravity of at least about 20°, 30°, or 40°. Inhibiting production until at least some hydrocarbons are mobilized and/or pyrolyzed may increase conversion of heavy hydrocarbons to light hydrocarbons. Inhibiting initial production may minimize the production of heavy hydrocarbons from the formation. Production of substantial amounts of heavy hydrocarbons may require expensive equipment and/or reduce the life of production equipment.

In some hydrocarbon containing formations, hydrocarbons in the formation may be heated to mobilization and/or pyrolysis temperatures before substantial permeability has been generated in the heated portion of the formation. An initial lack of permeability may inhibit the transport of generated fluids to production wells 206. During initial heating, fluid pressure in the formation may increase proximate heat sources 202. The increased fluid pressure may be released, monitored, altered, and/or controlled through one or more heat sources 202. For example, selected heat sources 202 or separate pressure relief wells may include pressure relief valves that allow for removal of some fluid from the formation.

In some embodiments, pressure generated by expansion of mobilized fluids, pyrolysis fluids or other fluids generated in the formation may be allowed to increase although an open path to production wells 206 or any other pressure sink may not yet exist in the formation. The fluid pressure may be allowed to increase towards a lithostatic pressure. Fractures in the hydrocarbon containing formation may form when the fluid approaches the lithostatic pressure. For example, fractures may form from heat sources 202 to production wells 206 in the heated portion of the formation. The generation of fractures in the heated portion may relieve some of the pressure in the portion. Pressure in the formation may have to be maintained below a selected pressure to inhibit unwanted production, fracturing of the overburden or underburden, and/or coking of hydrocarbons in the formation.

After mobilization and/or pyrolysis temperatures are reached and production from the formation is allowed, pressure in the formation may be varied to alter and/or control a composition of formation fluid produced, to control a percentage of condensable fluid as compared to non-condensable fluid in the formation fluid, and/or to control an API gravity of formation fluid being produced. For example, decreasing pressure may result in production of a larger condensable fluid component. The condensable fluid component may contain a larger percentage of olefins.

In some in situ heat treatment process embodiments, pressure in the formation may be maintained high enough to promote production of formation fluid with an API gravity of greater than 20°. Maintaining increased pressure in the formation may inhibit formation subsidence during in situ heat treatment. Maintaining increased pressure may reduce or eliminate the need to compress formation fluids at the surface to transport the fluids in collection conduits to treatment facilities.

Maintaining increased pressure in a heated portion of the formation may surprisingly allow for production of large quantities of hydrocarbons of increased quality and of relatively low molecular weight. Pressure may be maintained so that formation fluid produced has a minimal amount of compounds above a selected carbon number. The selected carbon number may be at most 25, at most 20, at most 12, or at most 8. Some high carbon number compounds may be entrained in vapor in the formation and may be removed from the formation with the vapor. Maintaining increased pressure in the formation may inhibit entrainment of high carbon number compounds and/or multi-ring hydrocarbon compounds in the vapor. High carbon number compounds and/or multi-ring hydrocarbon compounds may remain in a liquid phase in the formation for significant time periods. The significant time periods may provide sufficient time for the compounds to pyrolyze to form lower carbon number compounds.

Generation of relatively low molecular weight hydrocarbons is believed to be due, in part, to autogenous generation and reaction of hydrogen in a portion of the hydrocarbon containing formation. For example, maintaining an increased pressure may force hydrogen generated during pyrolysis into the liquid phase within the formation. Heating the portion to a temperature in a pyrolysis temperature range may pyrolyze hydrocarbons in the formation to generate liquid phase pyrolyzation fluids. The generated liquid phase pyrolyzation fluids components may include double bonds and/or radicals. Hydrogen ($H_2$) in the liquid phase may reduce double bonds of the generated pyrolyzation fluids, thereby reducing a potential for polymerization or formation of long chain compounds from the generated pyrolyzation fluids. In addition, $H_2$ may also neutralize radicals in the generated pyrolyzation fluids. $H_2$ in the liquid phase may inhibit the generated pyrolyzation fluids from reacting with each other and/or with other compounds in the formation.

Formation fluid produced from production wells 206 may be transported through collection piping 208 to treatment facilities 210. Formation fluids may also be produced from heat sources 202. For example, fluid may be produced from heat sources 202 to control pressure in the formation adjacent to the heat sources. Fluid produced from heat sources 202 may be transported through tubing or piping to collection piping 208 or the produced fluid may be transported through tubing or piping directly to treatment facilities 210. Treatment facilities 210 may include separation units, reaction units, upgrading units, fuel cells, turbines, storage vessels, and/or other systems and units for processing produced formation fluids. The treatment facilities may form transportation fuel from at least a portion of the hydrocarbons produced from the formation. In some embodiments, the transportation fuel may be jet fuel, such as JP-8.

Subsurface formations (for example, tar sands or heavy hydrocarbon formations) include dielectric media. Dielectric media may exhibit conductivity, relative dielectric constant, and loss tangents at temperatures below 100° C. Loss of conductivity, relative dielectric constant, and dissipation factor may occur as the formation is heated to temperatures above 100° C. due to the loss of moisture contained in the interstitial spaces in the rock matrix of the formation. To prevent loss of moisture, formations may be heated at temperatures and pressures that minimize vaporization of water. Conductive solutions may be added to the formation to help maintain the electrical properties of the formation.

Formations may be heated using electrodes to temperatures and pressures that vaporize the water and/or conductive solutions. Material used to produce the current flow, however, may become damaged due to heat stress and/or loss of conductive solutions may limit heat transfer in the layer. In addition, when using electrodes, magnetic fields may form. Due to the presence of magnetic fields, non-ferromagnetic materials may be desired for overburden casings.

Heat sources with electrically conducting material may allow current flow through a formation from one heat source to another heat source. Current flow between the heat sources with electrically conducting material may heat the formation to increase permeability in the formation and/or lower viscosity of hydrocarbons in the formation. Heating using current flow or "joule heating" through the formation may heat portions of the hydrocarbon layer in a shorter amount of time relative to heating the hydrocarbon layer using conductive heating between heaters spaced apart in the formation.

In some embodiments, heat sources that include electrically conductive materials are positioned in a hydrocarbon layer. Portions of the hydrocarbon layer may be heated from current generated from the heat sources that flows from the heat sources and through the layer. Positioning of electrically conductive heat sources in a hydrocarbon layer at depths sufficient to minimize loss of conductive solutions may allow hydrocarbons layers to be heated at relatively high temperatures over a period of time with minimal loss of water and/or conductive solutions.

Figure 2:
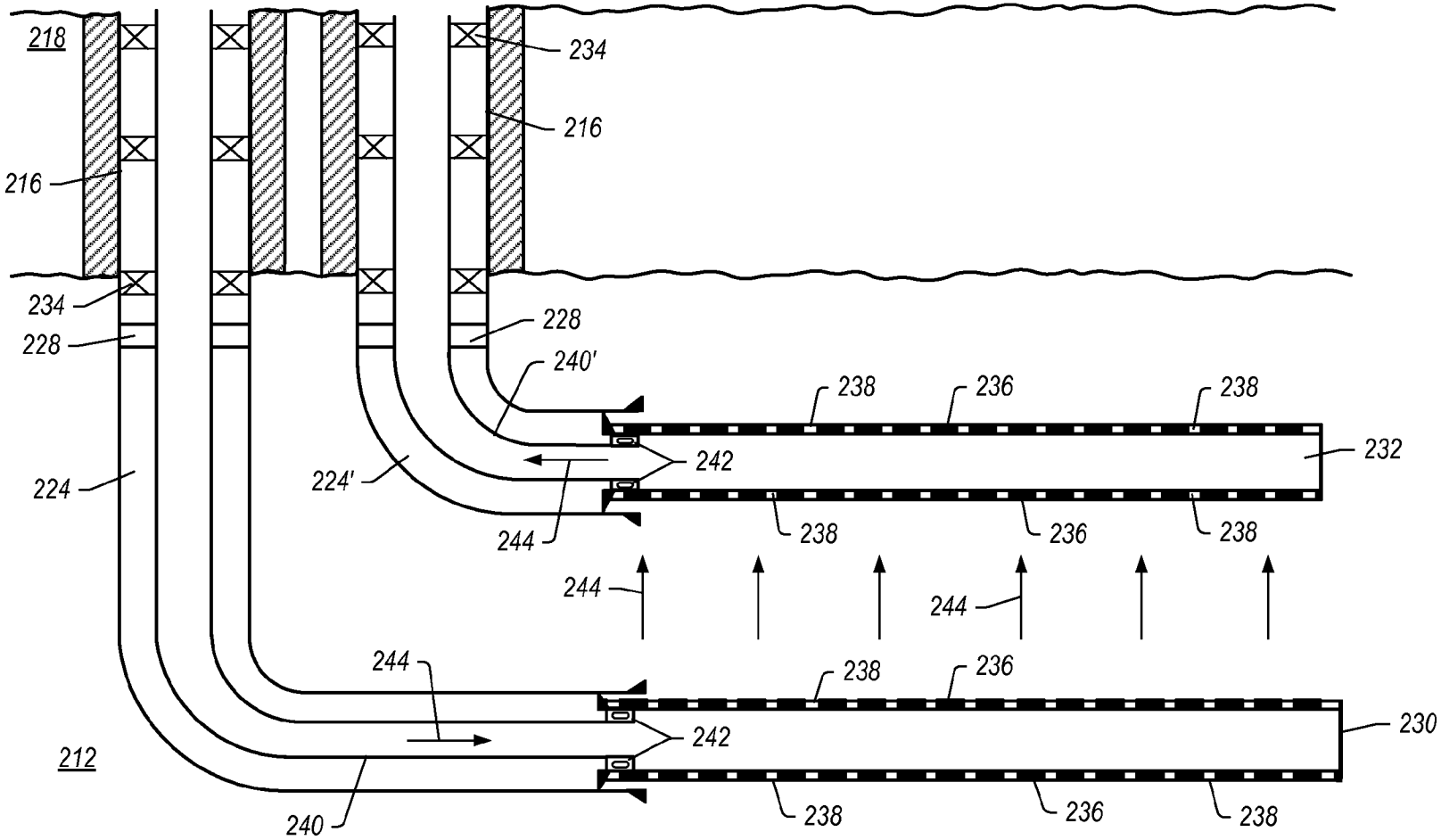
FIG. 2 depicts a schematic of an embodiment for treating a subsurface formation using heat sources having electrically conductive material.

FIGS. 2-6 depict schematics of embodiments for treating a subsurface formation using heat sources having electrically conductive material. FIG. 2 depicts first conduit 230 and second conduit 232 positioned in wellbores 224, 224' in hydrocarbon layer 212. In certain embodiments, first conduit 230 and/or second conduit 232 are conductors (for example, exposed metal or bare metal conductors). In some embodiments, conduits 230, 232 are oriented substantially horizontally or at an incline in the formation. Conduits 230, 232 may be positioned in or near a bottom portion of hydrocarbon layer 212.

Wellbores 224, 224' may be open wellbores. In some embodiments, the conduits extend from a portion of the wellbore. In some embodiments, the vertical or overburden portions of wellbores 224, 224' are cemented with non-conductive cement or foam cement. Wellbores 224, 224' may include packers 228 and/or electrical insulators 234. In some embodiments, packers 228 are not necessary. Electrical insulators 234 may insulate conduits 230, 232 from casing 216.

In some embodiments, the portion of casing 216 adjacent to overburden 218 is made of material that inhibits ferromagnetic effects. The casing in the overburden may be made of fiberglass, polymers, and/or a non-ferromagnetic metal (for example, a high manganese steel). Inhibiting ferromagnetic effects in the portion of casing 216 adjacent to overburden 218 may reduce heat losses to the overburden and/or electrical losses in the overburden. In some embodiments, overburden casings 216 include non-metallic materials such as fiberglass, polyvinylchloride (PVC), chlorinated polyvinylchloride (CPVC), high-density polyethylene (HDPE), and/or non-ferromagnetic metals (for example, non-ferromagnetic high manganese steels). HDPEs with working temperatures in a range for use in overburden 218 include HDPEs available from Dow Chemical Co., Inc. (Midland, Mich., U.S.A.). In some embodiments, casing 216 includes carbon steel coupled on the inside and/or outside diameter of a non-ferromagnetic metal (for example, carbon steel clad with copper or aluminum) to inhibit ferromagnetic effects or inductive effects in the carbon steel. Other non-ferromagnetic metals include, but are not limited to, manganese steels with at least 15% by weight manganese, 0.7% by weight carbon, 2% by weight chromium, iron aluminum alloys with at least 18% by weight aluminum, and austenitic stainless steels such as 304 stainless steel or 316 stainless steel.

Portions or all of conduits 230, 232 may include electrically conductive material 236. Electrically conductive materials include, but are not limited to, thick walled copper, heat treated copper ("hardened copper"), carbon steel clad with copper, aluminum, or aluminum or copper clad with stainless steel. Conduits 230, 232 may have dimensions and characteristics that enable the conduits to be used later as injection wells and/or production wells. Conduit 230 and/or conduit 232 may include perforations or openings 238 to allow fluid to flow into or out of the conduits. In some embodiments, portions of conduit 230 and/or conduit 232 are pre-perforated with coverings initially placed over the perforations and removed later. In some embodiments, conduit 230 and/or conduit 232 include slotted liners.

After a desired time (for example, after injectivity has been established in the layer), the coverings of the perforations may be removed or slots may be opened to open portions of conduit 230 and/or conduit 232 to convert the conduits to production wells and/or injection wells. In some embodiments, coverings are removed by inserting an expandable mandrel in the conduits to remove coverings and/or open slots. In some embodiments, heat is used to degrade material placed in the openings in conduit 230 and/or conduit 232. After degradation, fluid may flow into or out of conduit 230 and/or conduit 232.

Power to electrically conductive material 236 may be supplied from one or more surface power supplies through conductors 240, 240'. Conductors 240, 240' may be cables supported on a tubular or other support member. In some embodiments, conductors 240, 240' are conduits through which electricity flows to conduit 230 or conduit 232. Electrical connectors 242 may be used to electrically couple conductors 240, 240' to conduits 230, 232. Conductor 240 and conductor 240' may be coupled to the same power supply to form an electrical circuit. Sections of casing 216 (for example a section between packers 228 and electrical connectors 242) may include or be made of insulating material (such as enamel coating) to prevent leakage of electrical current towards the surface of the formation.

In some embodiments, a direct current power source is supplied to either first conduit 230 or second conduit 232. In some embodiments, time varying current is supplied to first conduit 230 and/or second conduit 232. Current flowing from conductors 240, 240' to conduits 230, 232 may be low frequency current (for example, about 50 Hz, about 60 Hz, or frequencies up to about 1000 Hz). A voltage differential between the first conduit 230 and second conduit 232 may range from about 100 volts to about 1200 volts, from about 200 volts to about 1000 volts, or from about 500 volts to 700 volts. In some embodiments, higher frequency current and/or higher voltage differentials may be utilized. Use of time varying current may allow longer conduits to be positioned in the formation. Use of longer conduits allows more of the formation to be heated at one time and may decrease overall operating expenses. Current flowing to first conduit 230 may flow through hydrocarbon layer 212 to second conduit 232, and back to the power supply. Flow of current through hydrocarbon layer 212 may cause resistance heating of the hydrocarbon layer.

During the heating process, current flow in conduits 230, 232 may be measured at the surface. Measuring of the current entering conduits 230, 232 may be used to monitor the progress of the heating process. Current between conduits 230, 232 may increase steadily until a predetermined upper limit ($I_{max}$) is reached. In some embodiments, vaporization of water occurs at the conduits, at which time a drop in current is observed. Current flow of the system is indicated by arrows 244. Current flow in hydrocarbon containing layer 212 between conduits 230, 232 heats the hydrocarbon layer between and around the conduits. Conduits 230, 232 may be part of a pattern of conduits in the formation that provide multiple pathways between wells so that a large portion of layer 212 is heated. The pattern may be a regular pattern (for example, a triangular or rectangular pattern) or an irregular pattern.

Figure 3:
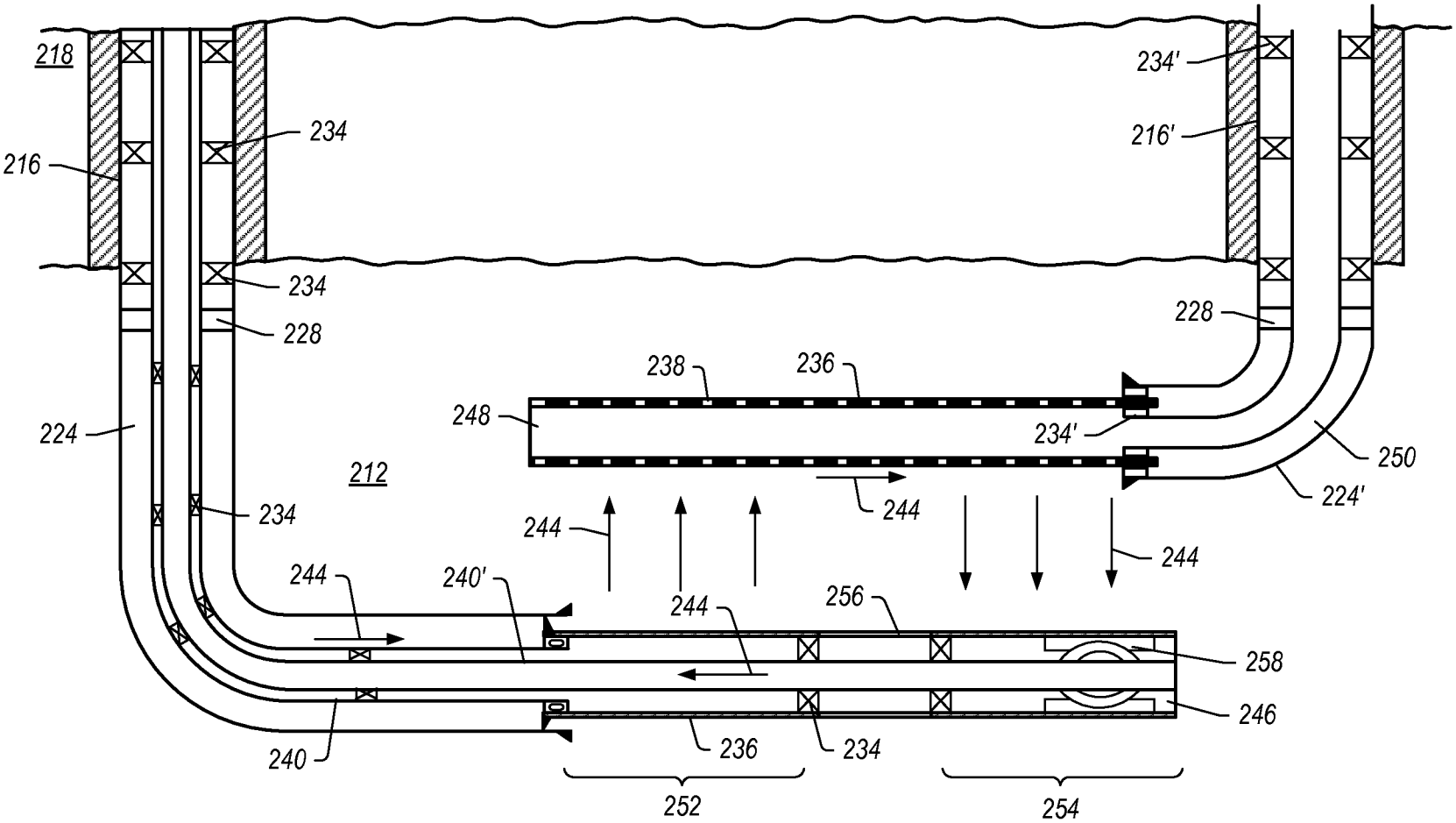
FIG. 3 depicts a schematic of an embodiment for treating a subsurface formation using a ground and heat sources having electrically conductive material.

FIG. 3 depicts a schematic of an embodiment of a system for treating a subsurface formation using electrically conductive material. Conduit 246 and ground 248 may extend from wellbores 224, 224' into hydrocarbon layer 212. Ground 248 may be a rod or a conduit positioned in hydrocarbon layer 212 between about 5 m and about 30 m away from conduit 246 (for example, about 10 m, about 15 m, or about 20 m). In some embodiments, electrical insulators 234' electrically isolate ground 248 from casing 216' and/or conduit section 250 positioned in wellbore 224'. As shown, ground 248 is a conduit that includes openings 238.

Conduit 246 may include sections 252, 254 of conductive material 236. Sections 252, 254 may be separated by electrically insulating material 256. Electrically insulating material 256 may include polymers and/or one or more ceramic isolators. Section 252 may be electrically coupled to the power supply by conductor 240. Section 254 may be electrically coupled to the power supply by conductor 240'. Electrical insulators 234 may separate conductor 240 from conductor 240'. Electrically insulating material 256 may have dimensions and insulating properties sufficient to inhibit current from section 252 flowing across insulation material 256 to section 254. For example, a length of electrically insulating material 256 may be about 30 meters, about 35 meters, about 40 meters, or greater. Using a conduit that has electrically conductive sections 252, 254 may allow fewer wellbores to be drilled in the formation. Conduits having electrically conductive sections ("segmented heat sources") may allow longer conduit lengths. In some embodiments, segmented heat sources allow injection wells used for drive processes (for example, steam assisted gravity drainage and/or cyclic steam drive processes) to be spaced further apart, and thus achieve an overall higher recovery efficiency.

Current provided through conductor 240 may flow to conductive section 252 through hydrocarbon layer 212 to a section of ground 248 opposite section 252. The electrical current may flow along ground 248 to a section of the ground opposite section 254. The current may flow through hydrocarbon layer 212 to section 254 and through conductor 240' back to the power circuit to complete the electrical circuit. Electrical connector 258 may electrically couple section 254 to conductor 240'. Current flow is indicated by arrows 244. Current flow through hydrocarbon layer 212 may heat the hydrocarbon layer to create fluid injectivity in the layer, mobilize hydrocarbons in the layer, and/or pyrolyze hydrocarbons in the layer. When using segmented heat sources, the amount of current required for the initial heating of the hydrocarbon layer may be at least 50% less than current required for heating using two non-segmented heat sources or two electrodes. Hydrocarbons may be produced from hydrocarbon layer 212 and/or other sections of the formation using production wells. In some embodiments, one or more portions of conduit 246 is positioned in a shale layer and ground 248 is positioned in hydrocarbon layer 212. Current flow through conductors 240, 240' in opposite directions may allow for cancellation of at least a portion of the magnetic fields due to the current flow. Cancellation of at least a portion of the magnetic fields may inhibit induction effects in the overburden portion of conduit 246 and the wellhead of wellbore 224.

Figure 4:
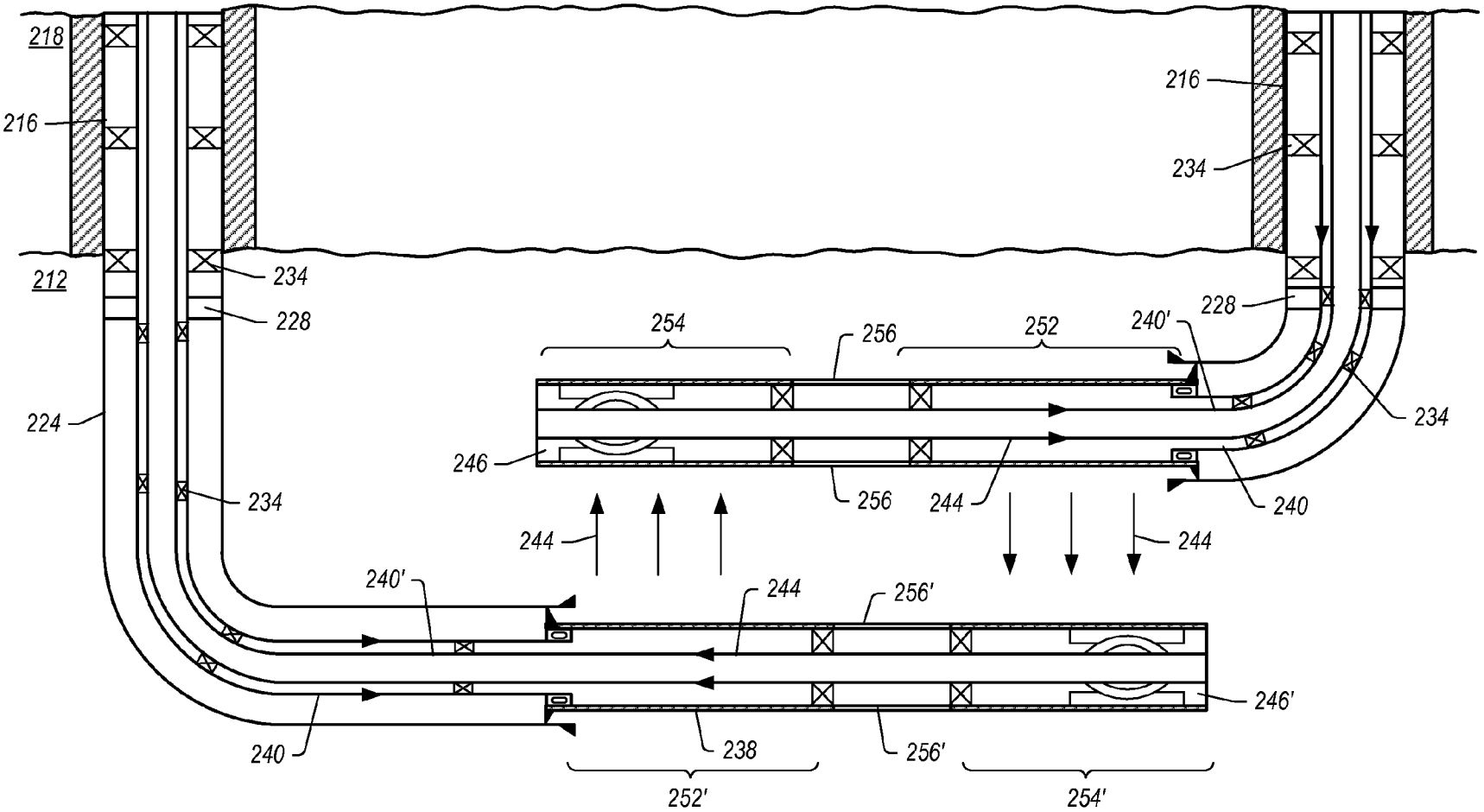
FIG. 4 depicts a schematic of an embodiment for treating a subsurface formation using heat sources having electrically conductive material and an electrical insulator.

FIG. 4 depicts an embodiment in which first conduit 246 and second conduit 246' are used for heating hydrocarbon layer 212. Electrically insulating material 256 may separate sections 252, 254 of first conduit 246. Electrically insulating material 256' may separate sections 252', 254' of second conduit 246'.

Current may flow from a power source through conductor 240 of first conduit 246 to section 252. The current may flow through hydrocarbon containing layer 212 to section 254' of second conduit 246'. The current may return to the power source through conductor 240' of second conduit 246'. Similarly, current may flow through conductor 240 of second conduit 246' to section 252', through hydrocarbon layer 212 to section 254 of first conduit 246, and the current may return to the power source through conductor 240' of the first conduit 246. Current flow is indicated by arrows 244. Generation of current flow from electrically conductive sections of conduits 246, 246' may heat portions of hydrocarbon layer 212 between the conduits and create fluid injectivity in the layer, mobilize hydrocarbons in the layer, and/or pyrolyze hydrocarbons in the layer. In some embodiments, one or more portions of conduits 246, 246' are positioned in shale layers.

By creating opposite current flow through the wellbores, as described with reference to FIGS. 3 and 4, magnetic fields in the overburden may cancel out. Cancellation of the magnetic fields in the overburden may allow ferromagnetic materials to be used in overburden casings 216. Using ferromagnetic casings in the wellbores may be less expensive and/or easier to install than non-ferromagnetic casings (such as fiberglass casings).

Figure 5:
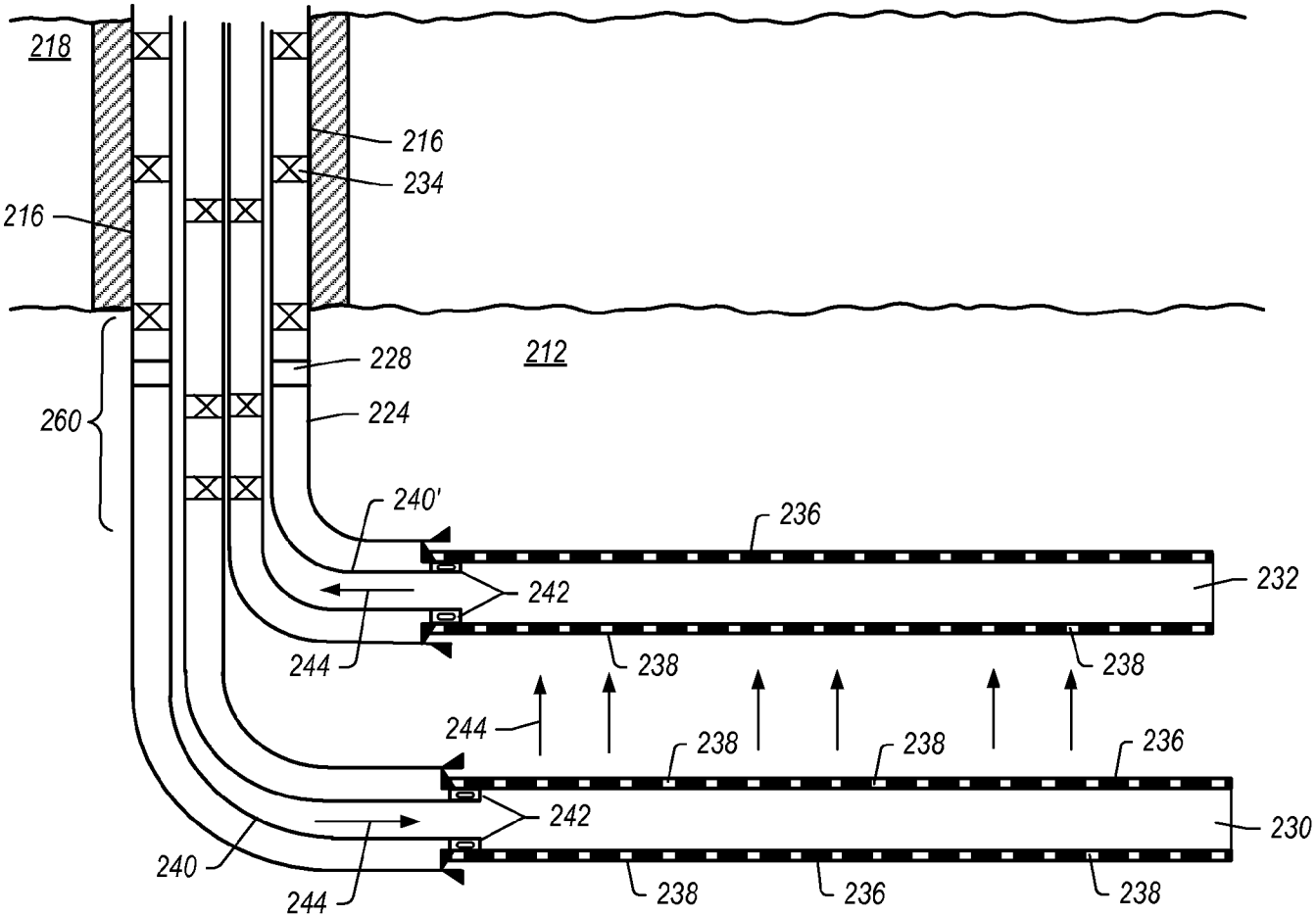
FIG. 5 depicts a schematic of an embodiment for treating a subsurface formation using electrically conductive heat sources extending from a common wellbore.

In some embodiments, two or more conduits may branch from a common wellbore. FIG. 5 depicts a schematic of an embodiment of two conduits extending from one common wellbore. Extending the conduits from one common wellbore may reduce costs by forming fewer wellbores in the formation. Using common wellbores may allow wellbores to be spaced further apart and produce the same heating efficiencies and the same heating times as drilling two different wellbores for each conduit through the formation. Using common wellbores may allow ferromagnetic materials to be used in overburden casing 216 since the magnetic fields cancel due to the approximately equal and opposite flow of current in the overburden section of conduits 230, 232. Extending conduits from one common wellbore may allow longer conduits to be used.

Conduits 230, 232 may extend from common vertical portion 260 of wellbore 224. Conduit 232 may be installed through an opening (for example, a milled window) in vertical portion 260. Conduits 230, 232 may extend substantially horizontally or inclined from vertical portion 260. Conduits 230, 232 may include electrically conductive material 236. In some embodiments, conduits 230, 232 include electrically conductive sections and electrically insulating material, as described for conduit 246 in FIGS. 3 and 4. Conduit 230 and/or conduit 232 may include openings 238. Current may flow from a power source to conduit 230 through conductor 240. The current may pass through hydrocarbon containing layer 212 to conduit 232. The current may pass from conduit 232 through conductor 240' back to the power source to complete the circuit. The flow of current as shown by arrows 244 through hydrocarbon layer 212 from conduits 230, 232 heats the hydrocarbon layer between the conduits.

Figure 7:
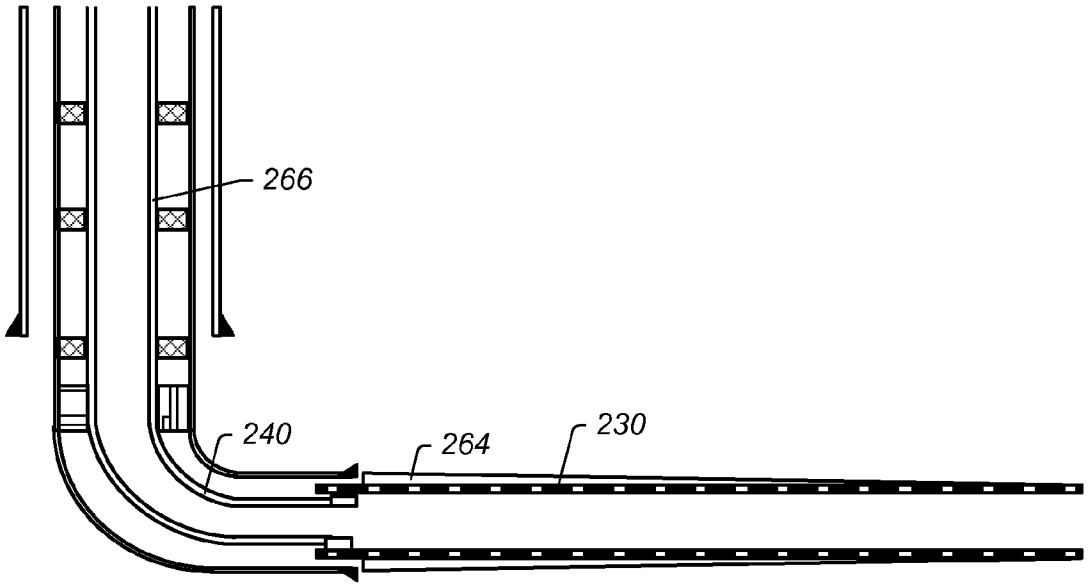
FIG. 7 depicts an embodiment of a conduit with heating zone cladding and a conductor with overburden cladding.

In certain embodiments, electrodes (such as conduits 230, 232, conduit 246, and/or ground 248) are coated or cladded with high electrical conductivity material to reduce energy losses. In some embodiments, overburden conductors (such as conductor 240) are coated or cladded with high electrical conductivity material. FIG. 7 depicts an embodiment of conduit 230 with heating zone cladding 264 and conductor 240 with overburden cladding 266. In certain embodiments, conduit 230 is made of carbon steel. Cladding 264 may be copper or another highly electrically conductive material. In certain embodiments, cladding 264 and/or cladding 266 is coupled to conduit 230 and/or conductor 240 by wrapping thin layers of the cladding onto the conduit or conductor. In some embodiments, cladding 264 and/or cladding 266 is coupled to conduit 230 and/or conductor 240 by depositing or coating the cladding using electrolysis.

In certain embodiments, overburden cladding 266 has a substantially constant thickness along the length of conductor 240 as the current along the conductor is substantially constant. In the hydrocarbon layer of the formation, however, electrical current flows into the formation and electrical current decreases linearly along the length of conduit 230 if current injection into the formation is uniform. Since current in conduit 230 decreases along the length of the conduit, heating zone cladding 264 can decrease in thickness linearly along with the current while still reducing energy losses to acceptable levels along the length of the conduit. Having heating zone cladding 264 taper to a thinner thickness along the length of conduit 230 reduces the total cost of putting the cladding on the conduit.

The taper of heating zone cladding 264 may be selected to provide certain electrical output characteristics along the length of conduit 230. In certain embodiments, the taper of heating zone cladding 264 is designed to provide an approximately constant current density along the length of the conduit such that the current decreases linearly along the length of the conduit. In some embodiments, the thickness and taper of heating zone cladding 264 is designed such that the formation is heated at or below a selected heating rate (for example, at or below about 160 W/m). In some embodiments, the thickness and taper of heating zone cladding 264 is designed such that a voltage gradient along the cladding is less than a selected value (for example, less than about 0.3 V/m).

In certain embodiments, analytical calculations may be made to optimize the thickness and taper of heating zone cladding 264. The thickness and taper of heating zone cladding 264 may be optimized to produce substantial cost savings over using a heating zone cladding of constant thickness. For example, it may be possible reduce costs by more than 50% by tapering heating zone cladding 264 along the length of conduit 230.

In certain embodiments, boreholes of electrodes (such as conduits 230, 232, conduit 246, and/or ground 248) are filled with an electrically conductive material and/or a thermally conductive material. For example, the insides of conduits may be filled with the electrically conductive material and/or the thermally conductive material. In certain embodiments, the wellbores with electrodes are filled with graphite, conductive cement, or combinations thereof. Filling the wellbore with electrically and/or thermally conductive material may increase the effective electrical diameter of the electrode for conducting current into the formation and/or increase distribution of any heat generated in the wellbore.

In some embodiments, a subsurface formation is heated using heating systems described in the embodiments depicted in FIGS. 2, 3, 4, and/or 5 to heat fluids in hydrocarbon layer 212 to mobilization, visbreaking, and/or pyrolyzation temperatures. Such heated fluids may be produced from the hydrocarbon layer and/or from other sections of the formation. As the hydrocarbon layer 212 is heated, the conductivity of the heated portion of the hydrocarbon layer increases. For example, conductivity of hydrocarbon layers close to the surface may increase by as much as a factor of three when the temperature of the formation increases from 20° C. to 100° C. For deeper layers, where the water vaporization temperature is higher due to increased fluid pressure, the increase in conductivity may be greater. Greater increases in conductivity may increase the heating rate of the formation. Thus, as the conductivity increases in the formation, increases in heating may be more concentrated in deeper layers.

As a result of heating, the viscosity of heavy hydrocarbons in a hydrocarbon layer is reduced. Reducing the viscosity may create more injectivity in the layer and/or mobilize hydrocarbons in the layer. As a result of being able to rapidly heat the hydrocarbon layer using heating systems described in the embodiments depicted in FIGS. 2, 3, 4, and/or 5, sufficient fluid injectivity in the hydrocarbon layer may be achieved more quickly, for example, in about two years. In some embodiments, these heating systems are used to create drainage paths between the heat sources and production wells for a drive and/or a mobilization process. In some embodiments, these heating systems are used to provide heat during the drive process. The amount of heat provided by the heating systems may be small compared to the heat input from the drive process (for example, the heat input from steam injection).

Once sufficient fluid injectivity has been established, a drive fluid, a pressuring fluid, and/or a solvation fluid may be injected in the heated portion of hydrocarbon layer 212. In some embodiments (for example, the embodiments depicted in FIGS. 2 and 5), conduit 232 is perforated and fluid is injected through the conduit to mobilize and/or further heat hydrocarbon layer 212. Fluids may drain and/or be mobilized towards conduit 230. Conduit 230 may be perforated at the same time as conduit 232 or perforated at the start of production. Formation fluids may be produced through conduit 230 and/or other sections of the formation.

Figure 6:
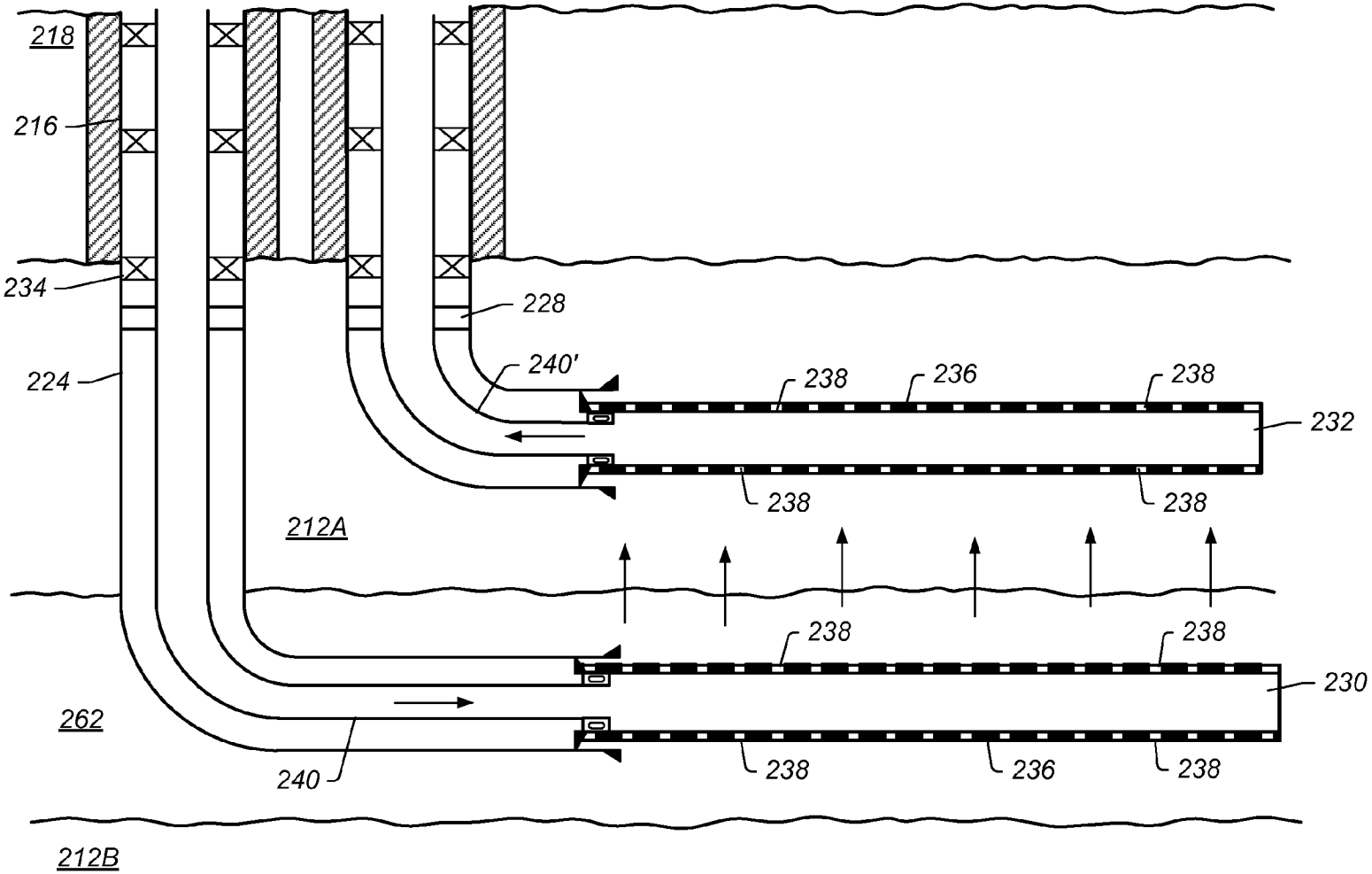
FIG. 6 depicts a schematic of an embodiment for treating a subsurface formation having a shale layer using heat sources having electrically conductive material.

As shown in FIG. 6, conduit 230 is positioned in layer 262 located between hydrocarbon layers 212A and 212B. Conduit 232 is positioned in hydrocarbon layer 212A. Conduits 230, 232, shown in FIG. 6, may be any of conduits 230, 232, depicted in FIGS. 2 and/or 5, as well as conduits 246, 246' or ground 248, depicted in FIGS. 3 and 4. In some embodiments, portions of conduit 230 are positioned in hydrocarbon layers 212A or 212B and in layer 262.

Layer 262 may be a conductive layer, water/sand layer, or hydrocarbon layer that has different porosity than hydrocarbon layer 212A and/or hydrocarbon layer 212B. In some embodiments, layer 262 is a shale layer. Layer 262 may have conductivities ranging from about 0.2 mho/m to about 0.5 mho/m. Hydrocarbon layers 212A and/or 212B may have conductivities ranging from about 0.02 mho/m to about 0.05 mho/m. Conductivity ratios between layer 262 and hydrocarbon layers 212A and/or 212B may range from about 10:1, about 20:1, or about 100:1. When layer 262 is a shale layer, heating the layer may desiccate the shale layer and increase the permeability of the shale layer to allow fluid to flow through the shale layer. The increased permeability in the shale layer allows mobilized hydrocarbons to flow from hydrocarbon layer 212A to hydrocarbon layer 212B, allows drive fluids to be injected in hydrocarbon layer 212A, and/or allows steam drive processes (for example, SAGD, cyclic steam soak (CSS), sequential CSS and SAGD or steam flood, or simultaneous SAGD and CSS) to be performed in hydrocarbon layer 212A.

In some embodiments, a conductive layer is selected to provide lateral continuity of conductivity within the conductive layer and to provide a substantially higher conductivity, for a given thickness, than the surrounding hydrocarbon layers. Thin conductive layers selected on this basis may substantially confine the heat generation within and around the conductive layers and allow much greater spacing between rows of electrodes. In some embodiments, layers to be heated are selected, on the basis of resistivity well logs, to provide lateral continuity of conductivity. Selection of layers to be heated is described in U.S. Pat. No. 4,926,941 to Glandt et al.

Once sufficient fluid injectivity is created, fluid may be injected in layer 262 through an injection well and/or conduit 230 to heat or mobilize fluids in hydrocarbon layer 212B. Fluids may be produced from hydrocarbon layer 212B and/or other sections of the formation. In some embodiments, fluid is injected in conduit 232 to mobilize and/or heat in hydrocarbon layer 212A. Heated and/or mobilized fluids may be produced from conduit 230 and/or other production wells located in hydrocarbon layer 212B and/or other sections of the formation.

In certain embodiments, a solvation fluid, in combination with a pressurizing fluid, is used to treat the hydrocarbon formation in addition to the in situ heat treatment process. In some embodiments, the solvation fluid, in combination with the pressurizing fluid, is used after the hydrocarbon formation has been treated using a drive process. In some embodiments, solvation fluids are foamed or made into foams to improve the efficiency of the drive process. Since an effective viscosity of the foam may be greater than the viscosity of the individual components, the use of a foaming composition may improve the sweep efficiency of the drive fluid.

In some embodiments, the solvation fluid includes a foaming composition. The foaming composition may be injected simultaneously or alternately with the pressurizing fluid and/or the drive fluid to form foam in the heated section. Use of foaming compositions may be more advantageous than use of polymer solutions since foaming compositions are thermally stable at temperatures up to 600° C. while polymer compositions may degrade at temperatures above 150° C. Use of foaming compositions at temperatures above about 150° C. may allow more hydrocarbon fluids and/or more efficient removal of hydrocarbons from the formation as compared to use of polymer compositions.

Foaming compositions may include, but are not limited to, surfactants. In certain embodiments, the foaming composition includes a polymer, a surfactant, an inorganic base, water, steam, and/or brine. The inorganic base may include, but is not limited to, sodium hydroxide, potassium hydroxide, potassium carbonate, potassium bicarbonate, sodium carbonate, sodium bicarbonate, or mixtures thereof. Polymers include polymers soluble in water or brine such as, but not limited to, ethylene oxide or propylene oxide polymers.

Surfactants include ionic surfactants and/or nonionic surfactants. Examples of ionic surfactants include alpha-olefinic sulfonates, alkyl sodium sulfonates, and sodium alkyl benzene sulfonates. Non-ionic surfactants include, for example, triethanolamine. Surfactants capable of forming foams include, but are not limited to, alpha-olefinic sulfonates, alkylpolyalkoxyalkylene sulfonates, aromatic sulfonates, alkyl aromatic sulfonates, alcohol ethoxy glycerol sulfonates (AEGS), or mixtures thereof. Non-limiting examples of surfactants capable of being foamed include AEGS 25-12 surfactant, sodium dodecyl 3EO sulfate, and sulfates made from branched alcohols made using the Guerbet method such as, for example, sodium dodecyl (Guerbert) 3PO sulfate[63], ammonium isotridecyl(Guerbert) 4PO sulfate[63], sodium tetradecyl (Guerbert) 4PO sulfate[63]. Nonionic and ionic surfactants and/or methods of use and/or methods of foaming for treating a hydrocarbon formation are described in U.S. Pat. Nos. 4,643,256 to Dilgren et al.; 5,193,618 to Loh et al.; 5,046,560 to Teletzke et al.; 5,358,045 to Sevigny et al.; 6,439,308 to Wang; 7,055,602 to Shpakoff et al.; 7,137,447 to Shpakoff et al.; 7,229,950 to Shpakoff et al.; and 7,262,153 to Shpakoff et al.; and by Wellington et al., in "Surfactant-Induced Mobility Control for Carbon Dioxide Studied with Computerized Tomography," American Chemical Society Symposium Series No. 373, 1988.

Foam may be formed in the formation by injecting the foaming composition during or after addition of steam. Pressurizing fluid (for example, carbon dioxide, methane, and/or nitrogen) may be injected in the formation before, during, or after the foaming composition is injected. A type of pressurizing fluid may be based on the surfactant used in the foaming composition. For example, carbon dioxide may be used with alcohol ethoxy glycerol sulfonates. The pressurizing fluid and foaming composition may mix in the formation and produce foam. In some embodiments, non-condensable gas is mixed with the foaming composition prior to injection to form a pre-foamed composition. The foaming composition, the pressurizing fluid, and/or the pre-foamed composition may be periodically injected in the heated formation. The foaming composition, pre-foamed compositions, drive fluids, and/or pressurizing fluids may be injected at a pressure sufficient to displace the formation fluids without fracturing the reservoir.

Figure 8:
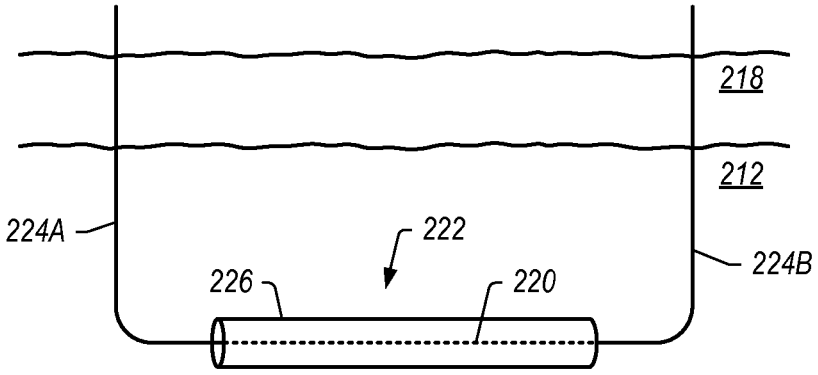
FIG. 8 depicts an embodiment of a u-shaped heater that has an inductively energized tubular.

FIG. 8 depicts an embodiment of a u-shaped heater that has an inductively energized tubular. Heater 222 includes electrical conductor 220 and tubular 226 in an opening that spans between wellbore 224A and wellbore 224B. In certain embodiments, electrical conductor 220 and/or the current carrying portion of the electrical conductor is electrically insulated from tubular 226. Electrical conductor 220 and/or the current carrying portion of the electrical conductor is electrically insulated from tubular 226 such that electrical current does not flow from the electrical conductor to the tubular, or vice versa (for example, the tubular is not electrically connected to the electrical conductor).

Figure 9:
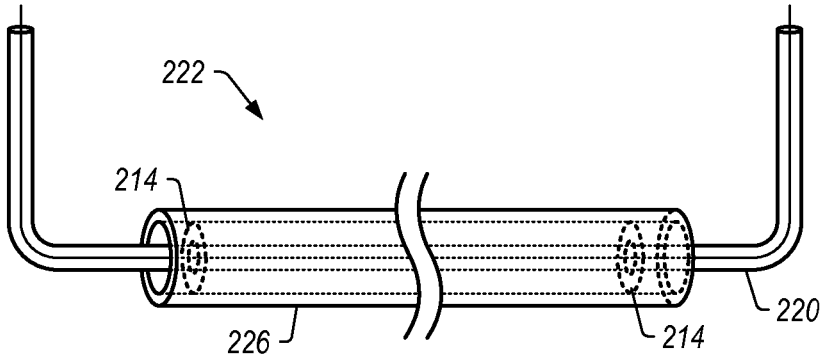
FIG. 9 depicts an embodiment of an electrical conductor centralized inside a tubular.

In some embodiments, electrical conductor 220 is centralized inside tubular 226 (for example, using centralizers 214 or other support structures, as shown in FIG. 9). Centralizers 214 may electrically insulate electrical conductor 220 from tubular 226. In some embodiments, tubular 226 contacts electrical conductor 220. For example, tubular 226 may hang, drape, or otherwise touch electrical conductor 220. In some embodiments, electrical conductor 220 includes electrical insulation (for example, magnesium oxide or porcelain enamel) that insulates the current carrying portion of the electrical conductor from tubular 226. The electrical insulation inhibits current from flowing between the current carrying portion of electrical conductor 220 and tubular 226 if the electrical conductor and the tubular are in physical contact with each other.

In some embodiments, electrical conductor 220 is an exposed metal conductor heater or a conductor-in-conduit heater. In certain embodiments, electrical conductor 220 is an insulated conductor such as a mineral insulated conductor. The insulated conductor may have a copper core, copper alloy core, or a similar electrically conductive, low resistance core that has low electrical losses. In some embodiments, the core is a copper core with a diameter between about 0.5" (1.27 cm) and about 1" (2.54 cm). The sheath or jacket of the insulated conductor may be a non-ferromagnetic, corrosion resistant steel such as 347 stainless steel, 625 stainless steel, 825 stainless steel, 304 stainless steel, or copper with a protective layer (for example, a protective cladding). The sheath may have an outer diameter of between about 1" (2.54 cm) and about 1.25" (3.18 cm).

Figure 10:
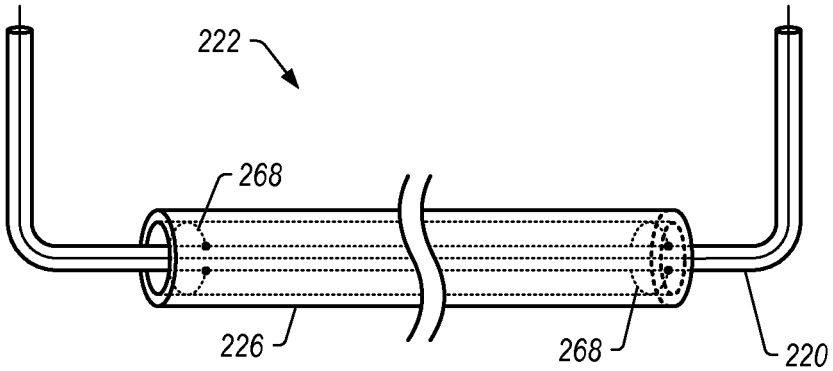
FIG. 10 depicts an embodiment of an induction heater with a sheath of an insulated conductor in electrical contact with a tubular.

In some embodiments, the sheath or jacket of the insulated conductor is in physical contact with the tubular 226 (for example, the tubular is in physical contact with the sheath along the length of the tubular) or the sheath is electrically connected to the tubular. In such embodiments, the electrical insulation of the insulated conductor electrically insulates the core of the insulated conductor from the jacket and the tubular. FIG. 10 depicts an embodiment of an induction heater with the sheath of an insulated conductor in electrical contact with tubular 226. Electrical conductor 220 is the insulated conductor. The sheath of the insulated conductor is electrically connected to tubular 226 using electrical contactors 268. In some embodiments, electrical contactors 268 are sliding contactors. In certain embodiments, electrical contactors 268 electrically connect the sheath of the insulated conductor to tubular 226 at or near the ends of the tubular. Electrically connecting at or near the ends of tubular 226 substantially equalizes the voltage along the tubular with the voltage along the sheath of the insulated conductor. Equalizing the voltages along tubular 226 and along the sheath may inhibit arcing between the tubular and the sheath.

Tubular 226, shown in FIGS. 8, 9, and 10, may be ferromagnetic or include ferromagnetic materials. Tubular 226 may have a thickness such that when electrical conductor 220 is energized with time-varying current, the electrical conductor induces electrical current flow on the surfaces of tubular 226 due to the ferromagnetic properties of the tubular (for example, current flow is induced on both the inside of the tubular and the outside of the tubular). Current flow is induced in the skin depth of the surfaces of tubular 226 so that the tubular operates as a skin effect heater. In certain embodiments, the induced current circulates axially (longitudinally) on the inside and/or outside surfaces of tubular 226. Longitudinal flow of current through electrical conductor 220 induces primarily longitudinal current flow in tubular 226 (the majority of the induced current flow is in the longitudinal direction in the tubular). Having primarily longitudinal induced current flow in tubular 226 may provide a higher resistance per foot than if the induced current flow is primarily angular current flow.

In certain embodiments, current flow in tubular 226 is induced with low frequency current in electrical conductor 220 (for example, from 50 Hz or 60 Hz up to about 1000 Hz). In some embodiments, induced currents on the inside and outside surfaces of tubular 226 are substantially equal.

In certain embodiments, tubular 226 has a thickness that is greater than the skin depth of the ferromagnetic material in the tubular at or near the Curie temperature of the ferromagnetic material or at or near the phase transformation temperature of the ferromagnetic material. For example, tubular 226 may have a thickness of at least 2.1, at least 2.5 times, at least 3 times, or at least 4 times the skin depth of the ferromagnetic material in the tubular near the Curie temperature or the phase transformation temperature of the ferromagnetic material. In certain embodiments, tubular 226 has a thickness of at least 2.1 times, at least 2.5 times, at least 3 times, or at least 4 times the skin depth of the ferromagnetic material in the tubular at about 50° C. below the Curie temperature or the phase transformation temperature of the ferromagnetic material.

In certain embodiments, tubular 226 is carbon steel. In some embodiments, tubular 226 is coated with a corrosion resistant coating (for example, porcelain or ceramic coating) and/or an electrically insulating coating. In some embodiments, electrical conductor 220 has an electrically insulating coating. Examples of the electrically insulating coating on tubular 226 and/or electrical conductor 220 include, but are not limited to, a porcelain enamel coating, alumina coating, or alumina-titania coating. In some embodiments, tubular 226 and/or electrical conductor 220 are coated with a coating such as polyethylene or another suitable low friction coefficient coating that may melt or decompose when the heater is energized. The coating may facilitate placement of the tubular and/or the electrical conductor in the formation.

In some embodiments, tubular 226 includes corrosion resistant ferromagnetic material such as, but not limited to, 410 stainless steel, 446 stainless steel, T/P91 stainless steel, T/P92 stainless steel, alloy 52, alloy 42, and Invar 36. In some embodiments, tubular 226 is a stainless steel tubular with cobalt added (for example, between about 3% by weight and about 10% by weight cobalt added) and/or molybdenum (for example, about 0.5% molybdenum by weight).

At or near the Curie temperature or the phase transformation temperature of the ferromagnetic material in tubular 226, the magnetic permeability of the ferromagnetic material decreases rapidly. When the magnetic permeability of tubular 226 decreases at or near the Curie temperature or the phase transformation temperature, there is little or no current flow in the tubular because, at these temperatures, the tubular is essentially non-ferromagnetic and electrical conductor 220 is unable to induce current flow or significant current flow in the tubular. With little or no current flow in tubular 226, the temperature of the tubular will drop to lower temperatures until the magnetic permeability increases and the tubular becomes ferromagnetic again. Thus, tubular 226 self-limits at or near the Curie temperature or the phase transformation temperature and operates as a temperature limited heater due to the ferromagnetic properties of the ferromagnetic material in the tubular. Because current is induced in tubular 226, the turndown ratio may be higher and the drop in current sharper for the tubular than for temperature limited heaters that apply current directly to the ferromagnetic material. For example, heaters with current induced in tubular 226 may have turndown ratios of at least about 5, at least about 10, or at least about 20 while temperature limited heaters that apply current directly to the ferromagnetic material may have turndown ratios that are at most about 5.

When current is induced in tubular 226, the tubular provides heat to hydrocarbon layer 212 and defines the heating zone in the hydrocarbon layer. In certain embodiments, tubular 226 heats to temperatures of at least about 300° C., at least about 500° C., or at least about 700° C. Because current is induced on both the inside and outside surfaces of tubular 226, the heat generation of the tubular is increased as compared to temperature limited heaters that have current directly applied to the ferromagnetic material and current flow is limited to one surface. Thus, less current may be provided to electrical conductor 220 to generate the same heat as heaters that apply current directly to the ferromagnetic material. Using less current in electrical conductor 220 decreases power consumption and reduces power losses in the overburden of the formation.

In certain embodiments, tubulars 226 have large diameters. The large diameters may be used to equalize or substantially equalize high pressures on the tubular from either the inside or the outside of the tubular. In some embodiments, tubular 226 has a diameter in a range between about 1.5" (about 3.8 cm) and about 5" (about 12.7 cm). In some embodiments, tubular 226 has a diameter in a range between about 3 cm and about 13 cm, between about 4 cm and about 12 cm, or between about 5 cm and about 11 cm. Increasing the diameter of tubular 226 may provide more heat output to the formation by increasing the heat transfer surface area of the tubular.

In some embodiments, fluids flow through the annulus of tubular 226 or through another conduit inside the tubular. The fluids may be used, for example, to cool down the heater, to recover heat from the heater, and/or to initially heat the formation before energizing the heater.

In some embodiments, a method for heating a hydrocarbon containing formation may include providing a time-varying electrical current at a first frequency to an elongated electrical conductor located in the formation using an inductive heater. Electrical current flow may be induced in a ferromagnetic conductor with the time-varying electrical current at the first frequency. In some embodiments, the ferromagnetic conductor may at least partially surround and at least partially extend lengthwise around the electrical conductor. The ferromagnetic conductor may be resistively heated with the induced electrical current flow. For example, the ferromagnetic conductor may be resistively heated with the induced electrical current flow such that the ferromagnetic conductor resistively heats up to a first temperature. The first temperature may be at most about 300° C. Heat may be allowed to transfer from the ferromagnetic conductor at the first temperature to at least a part of the formation. At least some water in the formation may be vaporized with the ferromagnetic conductor at the first temperature. At these lower temperatures (for example, up to about 260° C. or about 300° C.) coke may be inhibited from forming without inducing heater damage.

In some embodiments, the time-varying electrical current may be provided at a second frequency to the elongated electrical conductor. Electrical current flow may be induced in the ferromagnetic conductor with the time-varying electrical current at the second frequency. The ferromagnetic conductor may be resistively heated with the induced electrical current flow. For example, the ferromagnetic conductor may be resistively heated with the induced electrical current flow such that the ferromagnetic conductor resistively heats up to a second temperature. The second temperature may be above about 300° C. Heat may be allowed to transfer from the ferromagnetic conductor at the second temperature to at least a part of the formation. At least some hydrocarbons in the part of the formation may be mobilized with the ferromagnetic conductor at the second temperature. Caution must be taken with the second frequency, in that it must not be raised too high or the inductive heater may be damaged. In some embodiments, a multiple frequency low temperature inductive heater may be provided by Siemens AG (Munich, Germany).

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a core" includes a combination of two or more cores and reference to "a material" includes mixtures of materials.

In this patent, certain U.S. patents and U.S. patent applications have been incorporated by reference. The text of such U.S. patents and U.S. patent applications is, however, only incorporated by reference to the extent that no conflict exists between such text and the other statements and drawings set forth herein. In the event of such conflict, then any such conflicting text in such incorporated by reference U.S. patents and U.S. patent applications is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method for heating a hydrocarbon containing formation, comprising:

providing time-varying electrical current at a first frequency to a substantially u-shaped elongated electrical conductor located in the formation, wherein the electrical conductor extends between at least a first electrical contact at a first location on the surface of the formation and a second electrical contact at a second location on the surface of the formation;

inducing electrical current flow in a ferromagnetic conductor with the time-varying electrical current at the first frequency, wherein the ferromagnetic conductor at least partially surrounds and at least partially extends lengthwise around the electrical conductor in a hydrocarbon containing layer in the subsurface formation, and wherein the ferromagnetic conductor has no direct electrical connection to the electrical conductor;

resistively heating the ferromagnetic conductor with the induced electrical current flow such that the ferromagnetic conductor resistively heats up to a first temperature, wherein the first temperature is at most about 300° C.;

allowing heat to transfer from the ferromagnetic conductor at the first temperature to at least a part of the formation;

vaporizing at least some water in the formation with the ferromagnetic conductor at the first temperature;

providing time-varying electrical current at a second frequency to the elongated electrical conductor;

inducing electrical current flow in the ferromagnetic conductor with the time-varying electrical current at the second frequency;

resistively heating the ferromagnetic conductor with the induced electrical current flow such that the ferromagnetic conductor resistively heats up to a second temperature, wherein the second temperature is above about 300 ° C.;

allowing heat to transfer from the ferromagnetic conductor at the second temperature to at least a part of the formation; and mobilizing at least some hydrocarbons in the part of the formation with the ferromagnetic conductor at the second temperature.

2. The method of claim 1, wherein the ferromagnetic conductor has a thickness of at least 2.1 times the skin depth of the ferromagnetic material in the ferromagnetic conductor at 50 ° C. below the Curie temperature of the ferromagnetic material.

3. The method of claim 1, wherein the ferromagnetic conductor and the electrical conductor are configured in relation to each other such that electrical current does not flow from the electrical conductor to the ferromagnetic conductor, or vice versa.

4. The method of claim 1, further comprising providing different heat outputs along at least a portion of the length of the ferromagnetic conductor.

5. The method of claim 1, further comprising applying the electrical current to the electrical conductor in one direction from the first electrical contact to the second electrical contact.

6. The method of claim 1, further comprising providing heat from at least one additional heater located in the formation, wherein heat from the ferromagnetic conductor superpositions heat provided from the at least one additional heater.

7. The method of claim 1, further comprising providing heat from at least one additional ferromagnetic conductor located in the formation that resistively heats with induced electrical current flow, wherein heat from the ferromagnetic conductor superpositions heat provided from the at least one additional ferromagnetic conductor.

8. The method of claim 1, further comprising producing at least some of the mobilized hydrocarbons from the formation.

9. The method of claim 1, further comprising producing at least some of the mobilized hydrocarbons through a production well located in the formation.

10. The method of claim 1, further comprising pyrolyzing at least some hydrocarbons in the part of the formation with the ferromagnetic conductor at the second temperature.

11. The method of claim 10, further comprising producing at least some of the pyrolyzed hydrocarbons from the formation.

12. The method of claim 10, further comprising producing at least some of the pyrolyzed hydrocarbons through a production well located in the formation.

* * * * *